US012727738B2

(12) United States Patent
Na et al.

(10) Patent No.: US 12,727,738 B2
(45) Date of Patent: Sep. 8, 2026

(54) SHOE CARE DEVICE AND CONTROL METHOD THEREOF

(71) Applicant: Samsung Electronics Co., Ltd., Suwon-si (KR)

(72) Inventors: Joongwon Na, Suwon-si (KR); Minsoo Kim, Suwon-si (KR); Heemoon Jeong, Suwon-si (KR); Kookjeong Seo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 448 days.

(21) Appl. No.: 18/534,213

(22) Filed: Dec. 8, 2023

(65) Prior Publication Data

US 2024/0122442 A1 Apr. 18, 2024

Related U.S. Application Data

(63) Continuation of application No. PCT/KR2022/010205, filed on Jul. 13, 2022.

(30) Foreign Application Priority Data

Jul. 29, 2021 (KR) ..... 10-2021-0100209

(51) Int. Cl.
*A47L 23/20* (2006.01)
*A47L 23/18* (2006.01)

(52) U.S. Cl.
CPC ..... *A47L 23/205* (2013.01); *A47L 23/18* (2013.01)

(58) Field of Classification Search
CPC ..... F26B 9/06; F26B 21/006; F26B 21/333; F26B 21/35; F26B 21/37; F26B 21/50;
(Continued)

(56) References Cited

U.S. PATENT DOCUMENTS 7,191,546 B2 * 3/2007 Maruca ..... D06F 58/10 236/44 C
8,453,720 B2 6/2013 Song et al.
(Continued)

FOREIGN PATENT DOCUMENTS

CN 102517861 6/2012
EP 2460926 6/2012
(Continued)

OTHER PUBLICATIONS

Translation, KR-101071982-B1 (Year: 2011).*
(Continued)

*Primary Examiner* — Jessica Yuen
(74) *Attorney, Agent, or Firm* — Nixon & Vanderhye, P.C.

(57) ABSTRACT

The present disclosure relates to a shoe care apparatus including: a main body, a care room provided in the main body configured to accommodate shoes, a machine room provided in the main body configured to accommodate a heat pump device including an evaporator and a condenser, a circulation flow path configured to communicate with the care room so that air discharged from the care room passes through the evaporator and the condenser and is supplied to the care room, a first blower fan disposed on the circulation flow path configured to blow air in the circulation flow path in a first direction so that the air in the circulation flow path passes through the machine room from the care room and circulates back to the care room, and a second blower fan disposed in the machine room configured to blow air in the machine room in a second direction so that the air in the machine room passes through the condenser.

17 Claims, 16 Drawing Sheets

(58) Field of Classification Search
CPC ..... F26B 49/02; F26B 21/002; A47L 23/205; A47L 23/18; A47L 23/20; F25B 2600/111; F25B 2700/2104; F25B 2700/2106; F25B 39/04; F28F 1/126; F28F 9/001; F28F 9/0131; F28D 1/0477
See application file for complete search history.

(56) References Cited

U.S. PATENT DOCUMENTS

| | | | |
|---|---|---|---|
| 9,869,052 | B2 | 1/2018 | Liang et al. |
| 9,976,249 | B2 | 5/2018 | Lv et al. |
| 10,544,540 | B2 | 1/2020 | Lee |
| 11,085,143 | B2 | 8/2021 | Wakizaka et al. |
| 2009/0320314 | A1 | 12/2009 | Jo et al. |
| 2018/0066893 | A1 | 3/2018 | Bing et al. |

FOREIGN PATENT DOCUMENTS

| | | | | |
|---|---|---|---|---|
| EP | 2468948 | | 6/2012 | |
| JP | 2004-239549 | | 8/2004 | |
| JP | 5625883 | | 11/2014 | |
| JP | 6069797 | | 2/2017 | |
| JP | 2021040909 | | 3/2021 | |
| KR | 10-1995-0024772 | | 9/1995 | |
| KR | 20-0250736 | | 11/2001 | |
| KR | 20-0433313 | | 12/2006 | |
| KR | 10-0681425 | | 2/2007 | |
| KR | 10-0696397 | | 3/2007 | |
| KR | 10-0795207 | | 1/2008 | |
| KR | 10-0826537 | | 5/2008 | |
| KR | 10-0840737 | | 6/2008 | |
| KR | 10-2011-0098092 | | 9/2011 | |
| KR | 101071982 | B1 * | 10/2011 | ..... A47B 61/04 |
| KR | 20-0457168 | | 12/2011 | |
| KR | 10-2012-0015012 | | 2/2012 | |
| KR | 10-2013-0010177 | | 1/2013 | |
| KR | 10-2013-0018068 | | 2/2013 | |
| KR | 10-2013-0026835 | | 3/2013 | |
| KR | 10-2013-0035627 | | 4/2013 | |
| KR | 10-1265621 | | 5/2013 | |
| KR | 10-1318056 | | 10/2013 | |
| KR | 10-2014-0127986 | | 11/2014 | |
| KR | 10-1594260 | | 2/2016 | |
| KR | 10-2016-0059982 | | 5/2016 | |
| KR | 10-1661393 | | 9/2016 | |
| KR | 10-1711869 | | 3/2017 | |
| KR | 10-2017-0110120 | | 10/2017 | |
| KR | 10-1889821 | | 8/2018 | |
| KR | 10-2004349 | | 7/2019 | |
| KR | 10-2020-0002371 | | 1/2020 | |
| KR | 10-2020-0002725 | | 1/2020 | |
| KR | 10-2020-0130463 | | 11/2020 | |
| KR | 10-2021-0016968 | | 2/2021 | |
| KR | 10-2021-0016974 | | 2/2021 | |
| KR | 10-2021-0017015 | | 2/2021 | |
| KR | 10-2230674 | | 3/2021 | |
| KR | 10-2291415 | | 8/2021 | |
| KR | 10-2310173 | | 10/2021 | |
| KR | 10-2022-0145728 | | 10/2022 | |
| KR | 10-2022-0163193 | | 12/2022 | |
| WO | 2022/255723 | | 12/2022 | |
| WO | 2023/277314 | | 1/2023 | |

OTHER PUBLICATIONS

Extended European Search Report dated Sep. 23, 2024 issued in European Patent Application No. 22849762.4.
Korean Office Action issued May 27, 2025 in corresponding Korean Patent Application No. 10-2021-0100209.
European Office Action issued Jun. 4, 2025 in corresponding European Patent Application No. 22849762.4.
European Intention To Grant issued Feb. 12, 2026 in corresponding European Patent Application No. 22 849 762.4-1015.

* cited by examiner

SHOE CARE DEVICE AND CONTROL METHOD THEREOF

CROSS-REFERENCE TO RELATED APPLICATIONS

This application is a continuation of International Application No. PCT/KR2022/010205 designating the United States, filed on Jul. 13, 2022, in the Korean Intellectual Property Receiving Office and claiming priority to Korean Patent Application No. 10-2021-0100209, filed on Jul. 29, 2021, in the Korean Intellectual Property Office, the disclosures of each of which are incorporated by reference herein in their entireties.

BACKGROUND

Field

The present disclosure relates to a shoe care apparatus and a control method thereof, and for example, to a shoe care apparatus capable of controlling a temperature of air to be supplied into a care room and a control method thereof.

Description of Related Art

In general, a shoe care apparatus may refer to an apparatus for taking care of shoes, such as drying or cleaning shoes and removing shoe odors.

The shoe care apparatus may have devices therein that may include a heat pump cycle, such as an evaporator, condenser, and compressor. During a drying and/or cooling process, air in a care room may be cooled and dehumidified by flowing out of the care room and passing through an evaporator and condenser. The cooled and dehumidified air is then returned to the care room. In other words, air circulates through a flow path leading to the care room and a machine room.

In the case of a closed circulation method, because air is heated while the air continues to circulate within the shoe care apparatus, continuous heat accumulation occurs, and it may be difficult to cool and dehumidify air to be supplied to the inside of the care room. Therefore, there has recently been a need to improve the performance of the heat pump cycle, which cools and dehumidifies air introduced into the care room by preventing continuous heat accumulation.

SUMMARY

Embodiments of the disclosure provide a shoe care apparatus with increased efficiency of a heat pump cycle and a control method thereof.

Embodiments of the disclosure provide a shoe care apparatus capable of smoothly cooling and dehumidifying air to be supplied to a care room and a control method thereof.

Embodiments of the disclosure provide a shoe care apparatus capable of improving dehumidification performance and a control method thereof.

A shoe care apparatus according to an example embodiment of the present disclosure may include: a main body, a care room provided in the main body configured to accommodate shoes, a machine room provided in the main body configured to accommodate a heat pump device including an evaporator and a condenser, a circulation flow path communicating with the care room configured such that air discharged from the care room passes through the evaporator and the condenser and is supplied to the care room, a first blower fan disposed on the circulation flow path configured to blow air in the circulation flow path in a first direction so that the air in the circulation flow path passes through the machine room from the care room and circulates back to the care room, and a second blower fan disposed in the machine room configured to blow air in the machine room in a second direction so that the air in the machine room passes through the condenser.

The shoe care apparatus according to an example embodiment may further include: a communication hole provided in one wall of the main body configured to communicate the outside of the main body and the machine room, an inlet configured such that air introduced into the machine room through the communication hole flows into the condenser, and an outlet configured such that air introduced through the inlet passes through the condenser and flows into the machine room, wherein the air flowed out through the outlet is configured to flow to the outside of the main body through the communication hole.

The shoe care apparatus according to an example embodiment may further include at least one of a first damper configured to open and close the inlet and a second damper configured to open and close the outlet.

The condenser according to an example embodiment may include: a refrigerant pipe configured to flow a refrigerant therethrough, a first heat exchange fin configured to exchange heat between the air flowing through the circulation flow path by being blown by the first blower fan and the refrigerant flowing through the refrigerant pipe, and a second heat exchange fin disposed along an up-down direction together with the first heat exchange fin and configured to exchange heat between the air flowing through the condenser by being blown by the second blower fan and the refrigerant flowing through the refrigerant pipe.

The condenser according to an example embodiment may include: a first cover disposed on one side of the second heat exchange fin along the second direction, and a second cover disposed on an other side of the second heat exchange fin along the second direction.

Each of the first cover and the second cover according to an example embodiment may include: a cover portion, an opening formed at the cover portion configured to allow air to flow in the second direction, and a bent portion bent from the cover portion toward the second heat exchange fin to form the opening.

The condenser according to an example embodiment may further include: a sealing disposed between the first cover and the second cover along a front-rear direction configured to provide a seal between the opening and the bent portion on a side of the second heat exchange fin.

The shoe care apparatus according to an example embodiment may further include: at least one controller, comprising circuitry, configured to control the second blower fan based on at least one of a temperature of air to be supplied to the care room, an outside air temperature, a temperature of air in the machine room, and operation information of a compressor of the heat pump device.

At least one controller according to an example embodiment may be configured to operate the second blower fan based on the temperature of the air to be supplied to the care room being greater than or equal to a specified temperature.

At least one controller according to an example embodiment may be configured to operate the second blower fan based on the outside air temperature being greater than or equal to a specified temperature.

At least one controller according to an example embodiment may be configured to operate the second blower fan based on an operating rate of the compressor being less than or equal to a specified operating rate.

At least one controller according to an example embodiment may be configured to stop the operation of the second blower fan based on the temperature of the air in the machine room having fallen lower than or equal to a specified temperature while the second blower fan operates.

The shoe care apparatus according to an example embodiment may further include: at least one controller configured to control an operation of at least one of the first damper and the second damper based on at least one of a temperature of air supplied to the care room, a temperature of the outside air, a temperature of air in the machine room, and operation information of a compressor of the heat pump device.

At least one controller according to an example embodiment may be configured to open at least one of the first damper and the second damper based on the temperature of the air to be supplied to the care room being greater than or equal to a specified temperature.

At least one controller according to an example embodiment may be configured to open at least one of the first damper and the second damper based on the outside air temperature being greater than or equal to a specified temperature.

At least one controller according to an example embodiment may be configured to open at least one of the first damper and the second damper based on an operating rate of the compressor being less than or equal to a specified operating rate.

At least one controller according to an example embodiment may be configured to close at least one of the first damper and the second damper based on the temperature of the air in the machine room having fallen lower than or equal to a specified temperature in a state in which the at least one of the first damper and the second damper is opened.

A shoe care apparatus according to an example embodiment of the present disclosure may include: a main body, a care room provided in the main body configured to accommodate shoes, a machine room provided on one side of the care room in the main body, a duct disposed on one side of the machine room configured to communicate with the care room and accommodate an evaporator and a condenser, a circulation flow path formed within the duct configured such that air discharged from the care room passes through the evaporator and the condenser and is supplied to the care room and a portion of which extends in a first direction, and a blower fan configured to blow air in the machine room in a second direction so that the air in the machine room passes through the condenser disposed within the duct.

The shoe care apparatus according to an example embodiment may further include: a communication hole provided in one wall of the main body configured to communicate the outside of the main body and the machine room, an inlet configured such that air introduced into the machine room through the communication hole flows into the condenser, and an outlet configured such that air introduced through the inlet passes through the condenser and flows into the machine room, wherein the air flowed out through the outlet flows to the outside of the main body through the communication hole.

The shoe care apparatus according to an example embodiment may further include at least one of a first damper configured to open and close the inlet and a second damper configured to open and close the outlet.

A method of controlling a shoe care apparatus according to an example embodiment of the present disclosure, including a machine room provided in a main body to accommodate a heat pump device including an evaporator and a condenser, a circulation flow path configured such that air discharged from a care room accommodating shoes passes through the evaporator and the condenser and is supplied to the care room, a first blower fan disposed on the circulation flow path configured to blow air in the circulation flow path in a first direction so that the air in the circulation flow path passes through the machine room from the care room and circulates back to the care room, and a second blower fan disposed in the machine room configured to blow air in the machine room in a second direction so that the air in the machine room passes through the condenser, may include: operating the first blower fan based on start of a shoe care course, and operating the second blower fan based on a specified condition being satisfied while the shoe care course is in progress.

The method of operating the second blower fan based on the specified condition being satisfied while the shoe care course is in progress may include: operating the second blower fan based on at least one of a temperature of air to be supplied to the care room, an outside air temperature, and operation information of a compressor of the heat pump device.

The method of operating the second blower fan based on at least one of the temperature of the air to be supplied to the care room, the outside air temperature, and the operation information of the compressor of the heat pump device may include: operating the second blower fan based on the temperature of the air to be supplied to the care room being greater than or equal to a first specified temperature, the outside air temperature being greater than or equal to a second specified temperature, or an operating rate of the compressor being less than or equal to a specified operating rate.

The method of operating a shoe care apparatus may further include: stopping operation of the second blower fan based on a temperature of the air in the machine room having fallen lower than or equal to a specified temperature while the second blower fan operates.

A shoe care apparatus and a control method thereof according to various example embodiments of the present disclosure can smoothly cool and dehumidify air in a main body because the efficiency of a heat pump cycle is increased.

The shoe care apparatus and the control method thereof according to various example embodiments of the present disclosure can maintain dehumidification performance and prevent and/or reduce malfunction of a heat pump device even when an outside air temperature is high.

BRIEF DESCRIPTION OF THE DRAWINGS

The above and other aspects, features and advantages of certain embodiments of the present disclosure will be more apparent from the following detailed description, taken in conjunction with the accompanying drawings, in which.

DETAILED DESCRIPTION

Figure 1:
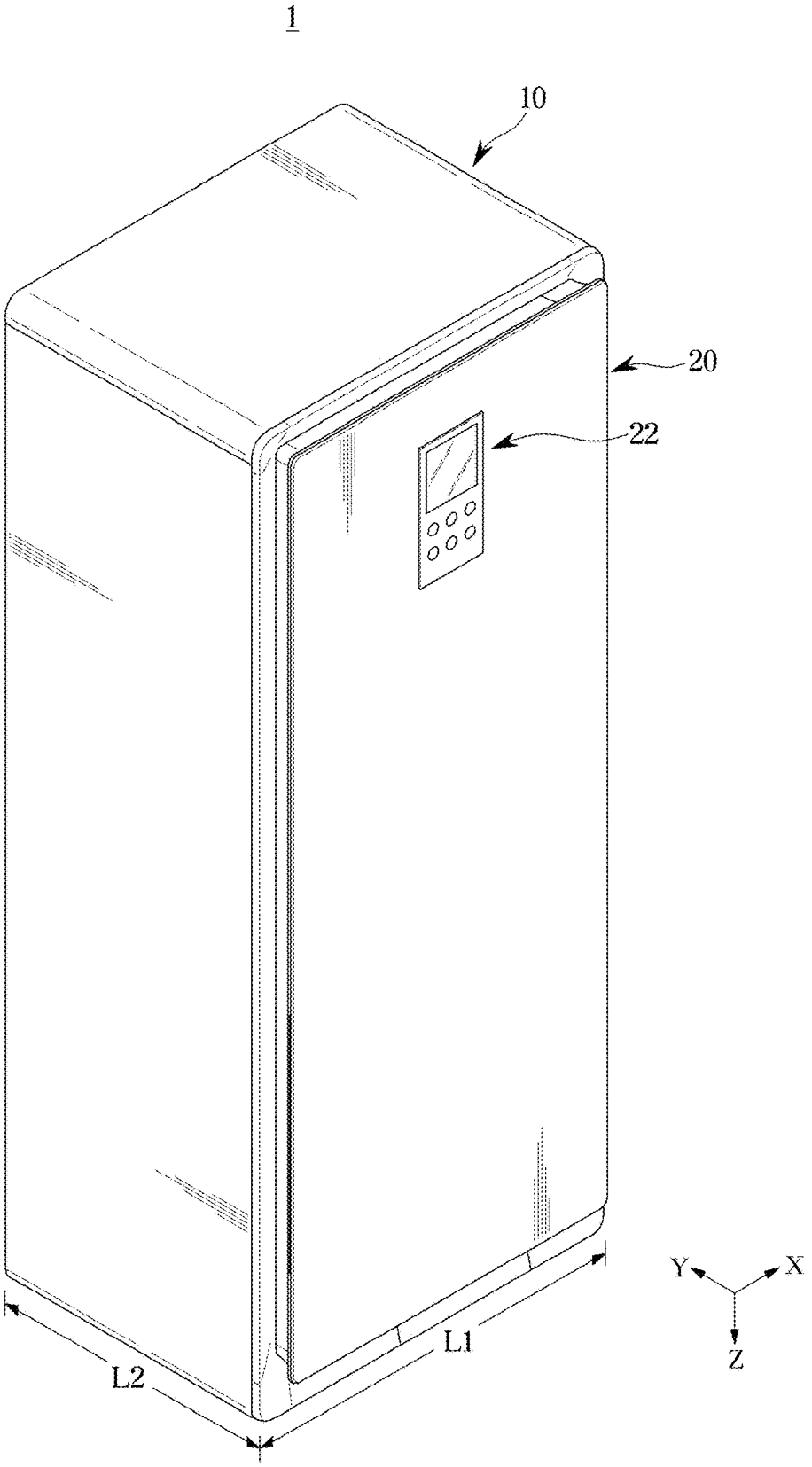
FIG. 1 is a perspective view of a shoe care apparatus according to various embodiments.

The embodiments described in the present disclosure and the configurations shown in the drawings are only examples of various embodiments of the present disclosure, and various modifications may be made at the time of filing of the present disclosure to replace and/or modify the embodiments and drawings of the present disclosure.

Like reference numbers or signs in the various drawings represent like parts or components that perform substantially the same functions.

The terms used herein are for the purpose of describing the embodiments and are not intended to restrict and/or to limit the present disclosure. For example, the singular expressions herein may include plural expressions, unless the context clearly dictates otherwise. Also, the terms "comprises" and "has" are intended to indicate that there are features, numbers, steps, operations, components, parts, or combinations thereof described in the disclosure, and do not exclude the presence or addition of one or more other features, numbers, steps, operations, components, parts, or combinations thereof.

It will be understood that, although the terms "first," "second," etc. may be used herein to describe various components, these components should not be limited by these terms, the terms are simply used to distinguish one component from another. For example, without departing from the scope of the present disclosure, a first component may be referred to as a second component, and similarly, the second component may also be referred to as a first component. The term "and/or" includes any combination of a plurality of related items or any one of a plurality of related items.

In this disclosure, the terms "front," "rear," "left," "right," etc. used in the following description are defined with reference to the drawings, and the shape and position of each component are not limited by these terms.

Hereinafter, various example embodiments of the present disclosure will be described in greater detail with reference to the accompanying drawings.

Figure 2:
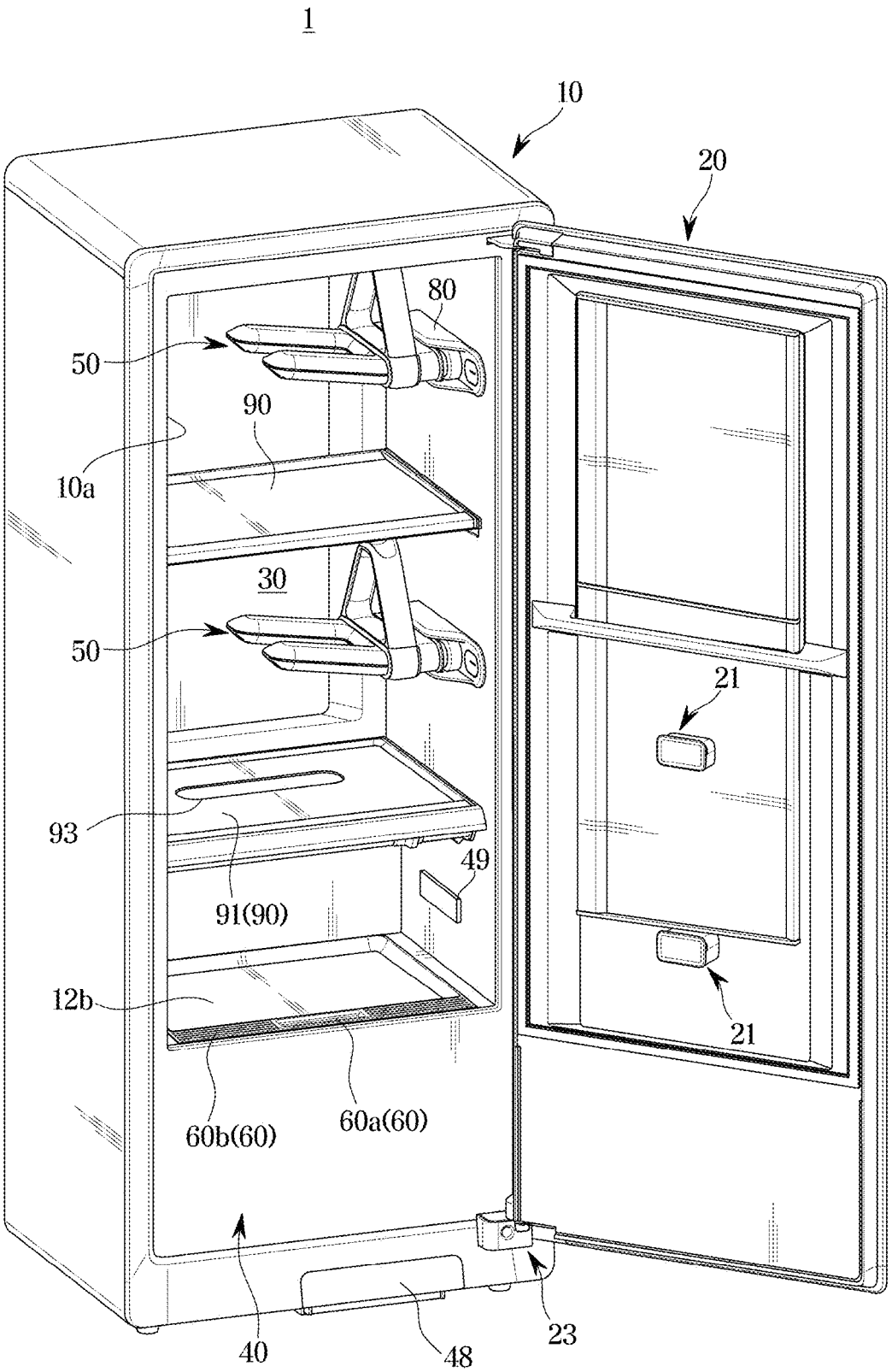
FIG. 2 is a perspective view illustrating a state in which a door is opened in the shoe care apparatus illustrated in FIG. 1 according to various embodiments.
Figure 3:
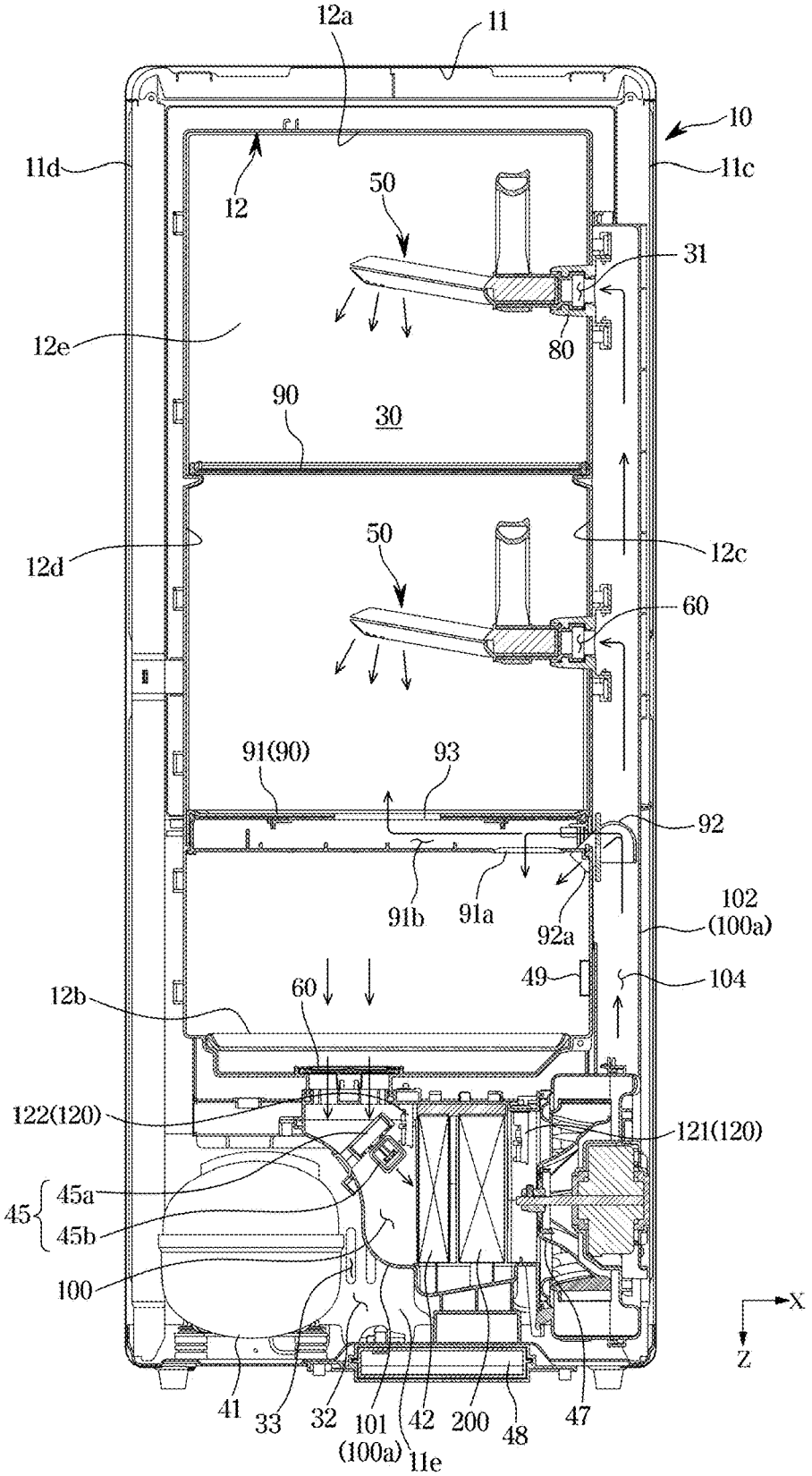
FIG. 3 is a front cross-sectional view of the shoe care apparatus illustrated in FIG. 1 according to various embodiments.

FIG. 1 is a perspective view of a shoe care apparatus according to various embodiments. FIG. 2 is a perspective view illustrating a state in which a door is opened in the shoe care apparatus illustrated in FIG. 1 according to various embodiments. FIG. 3 is a front cross-sectional view of the shoe care apparatus illustrated in FIG. 1 according to various embodiments.

Referring to FIGS. 1, 2 and 3 (which may be referred to herein as FIGS. 1 to 3), a shoe care apparatus 1 may include a main body 10 forming an exterior and a door 20 rotatably coupled to the main body 10.

The main body 10 may be provided in a rectangular parallelepiped shape with an open front surface. An opening 10*a* may be formed in the open front surface of the main body 10. The door 20 may be provided to open and close the open front surface of the main body 10 by being rotatably coupled to the main body 10. The door 20 may be coupled to the main body 10 by a hinge 23.

The main body 10 may be formed such that a length of the front surface extending in a first direction X is different from a length of a side surface extending in a second direction Y. That is, a length L1 of the front surface of the main body 10 may be longer than a length L2 of the side surface of the main body 10. Accordingly, the shoe care apparatus 1 may be easily installed even in a narrow entrance. The length of the front surface of the main body 10 may be defined as the first length L1, and the length of the side surface of the main body 10 may be defined as the second length L2.

The door 20 may include a control panel 22 provided on the front surface and/or an upper surface. The control panel 22 may receive various commands from a user. The control panel 22 may also display a variety of information about operations of the shoe care apparatus 1. For example, using the control panel 22, the user may select a type of shoes to care for and set an appropriate care course for the shoes.

The control panel 22 may include a display provided to display information about the operations of the shoe care apparatus 1. The control panel 22 may also include at least one of buttons and a touch screen.

The door 20 may include a hanging member 21. The hanging member 21 may be provided on one surface of the door 20 facing the inside of a care room 30, and one or more of the hanging members 21 may be provided. The hanging member 21 may be used to hang a handle of a holder 50. The holder 50 may be easily stored by the hanging member 21. The hanging member 21 may also be used for another use.

The main body 10 may include an outer case 11 and an inner case 12 disposed inside the outer case 11. The care room 30 may be formed inside the main body 10. For example, the inner case 12 may form the care room 30. The holder 50 capable of holding shoes may be provided inside the care room 30. The inner case 12 may be referred to as a case.

The care room 30 may form a space in which shoes are accommodated. The care room 30 may be formed by an upper surface 12*a*, a lower surface 12*b*, a left surface 12*c*, a right surface 12*d*, and a rear surface 12*e* of the inner case 12. The shoes may be accommodated and cared for in care room 30. The upper surface 12*a*, lower surface 12*b*, left surface 12*c*, right surface 12*d*, and rear surface 12*e* of the inner case 12 may be the upper wall 12*a*, lower wall 12*b*, left wall 12*c*, right wall 12*d*, and rear wall 12*e* of the inner case 12, respectively.

The holder 50 and a mounting rail 80 may be provided in the care room 30. The holder 50 and the mounting rail 80 may be installed on the left surface 12*c* or the right surface 12*d* of the inner case 12. That is, the holder 50 may be installed such that a side of a shoe is visible when viewed from the front of the shoe care apparatus 1. For this purpose, the length of the side surface of the main body 10 may be shorter than the length of the front surface of the main body 10. However, the positions of the holder 50 and the mounting rail 80 are not limited to those illustrated.

One or more of the holders 50 may be provided. The holder 50 may be provided in a shape that may be inserted into the shoe. In addition, the holder 50 may be separated from the care room 30. That is, the holder 50 may be coupled to the mounting rail 80 provided on the side surface of the care room 30 and may be separated from the mounting rail 80. For example, the holder 50 may be inserted into the mounting rail 80 along the second direction Y. Because the holder 50 is separable, the space in the care room 30 may be used efficiently depending on a size of the shoe.

The shoe care apparatus 1 may include an air outlet 31 and an air inlet 60. The air outlet 31 may be formed on a side wall of the inner case 12. For example, the air outlet 31 may be formed on the left surface 12*c* of the care room 30. A plurality of the air outlets 31 may be provided. The air outlet 31 may allow air passed through a duct 100*a* to flow out into the care room. In other words, air cooled and dehumidified by an evaporator 42 in the duct 100*a* may flow to a condenser 200, air heated by the condenser 200 may be supplied into the care room 30 through the air outlet 31.

The air inlet 60 may be formed on one side surface of the inner case 12. For example, the air inlet 60 may be formed on the lower surface 12*b* of the inner case 12. Specifically, the air inlet 60 may be disposed in front of the lower surface 12*b*. Air in the care room 30 may be introduced into the duct 100*a* through the air inlet 60. The air inlet 60 may be include a grill 60*b* including a central hole 60*a* and a plurality of side holes.

The shoe care apparatus may include the machine room 32, the condenser 200, a compressor 41, the evaporator 42, and a communication hole 33.

The machine room 32 may be provided on one side of the care room 30. For example, the machine room 32 may be provided below the care room 30. At least a portion of the duct 100*a* may be accommodated in the machine room 32. A heat pump device 40 including the compressor 41, an expander 44, the evaporator 42, and the condenser 200 may be disposed in the machine room 32. The machine room 32 may accommodate the compressor 41, the expander 44, the evaporator 42, and the condenser 200. A sterilizing device 49 may be provided inside the care room 30 or the machine room 32. FIGS. 2 and 3 illustrate that the sterilizing device 49 is provided inside the care room 30.

Air in the machine room 32 may communicate with air outside the shoe care apparatus 1 through the communication hole 33. The communication hole 33 may be provided at the rear of the machine room 32. The communication hole 33 may be provided on a rear wall 11*e* of the main body 10. For example, the communication hole 33 may be provided on the rear wall 11*e* of the outer case 11. However, the present disclosure is not limited thereto, and the communication hole 33 may be provided at various positions as long as it may communicate between the machine room 32 and the outside of the main body 10. For example, the communication hole 33 may be formed on side walls 11*c* and 11*d* of the outer case 11.

The duct 100*a* may be provided on one side of the care room 30. For example, the duct 100*a* may be disposed below the care room 30, on the left wall 12*c* and/or the right wall 12*d*. The duct 100*a* may also be provided on one side of the machine room 32. For example, the duct 100*a* may be disposed at an upper portion of the machine room 32. However, the present disclosure is not limited thereto, and the duct 100*a* may be included in the machine room 32. The evaporator 42, the condenser 200, a deodorizing device 45, a first blower fan 47, and a temperature sensor 120 may be provided in the duct 100*a*.

The compressor 41, evaporator 42, condenser 200, and expander 44 may be defined as the heat pump device 40. A refrigerant may flow through the compressor 41, the evaporator 42, the condenser 200, and the expander through a refrigerant pipe 40*a* (described later) of the heat pump device 40.

The heat pump device 40 may cool, dehumidify, and heat air circulating in the care room 30. The heat pump device 40 may dehumidify air flowed out of the care room 30 and then introduce air heated through the condenser 200 into the care room 30.

The duct 100*a* may include a first duct 101 located below the care room 30. The first duct 101 may also be referred to as the lower duct 101. The first duct 101 may form one portion of a circulation flow path 100 connected to the air inlet 60 of the care room 30 and guiding air passed through the air inlet 60 to the first blower fan 47. The duct 100*a* may include a second duct 102 provided on the left wall 12*c* and/or the right wall 12*d* forming the care room 30. The first duct 101 may be connected to the second duct 102 provided on a side wall of the main body 10. The second duct 102 may be referred to as the side duct 102.

The second duct 102 may be provided outside the side walls 12*c* and 12*d* of the inner case 12 in the second direction Y of the shoe care apparatus 1. One end of the second duct 102 may be connected to at least one of the air outlets 31, and the other end may be connected to the first duct 100*a*. The second duct 102 may form an exhaust flow path 104 guiding air to the air outlet 31.

The evaporator 42 and the condenser 200 may be disposed in the first duct 100*a*. The evaporator 42, the condenser 200, and the first blower fan 47 may be arranged in the first direction X. The evaporator 42 may be located upstream of the condenser 200 based on an air flow.

The first blower fan 47 may be provided between the heat pump device 40 and the care room 30 to circulate air. The first blower fan 47 may rotate based on a predetermined RPM (revolutions per minute). Specifically, the first blower fan 47 may draw air introduced into the first duct 100*a* and discharge the air toward the second duct 102. The air introduced into the first duct 100*a* through the air inlet 60 may be dried while passing through the evaporator 42 of the heat pump device 40, heated while passing through the condenser 200, and discharged back to the care room 30 through the second duct 102 and the air outlet 31.

The deodorizing device 45 may also be disposed inside the first duct 100*a*. The deodorizing device 45 may include, for example, and without limitation, a deodorizing filter 45*a* and a UV LED 45*b*. The deodorizing filter 45*a* and the UV LED 45*b* may be disposed in a position close to the air inlet 60 of the care room 30. The UV LED 45*b* may remove odors contained in air by irradiating light to the deodorizing filter 45*a*. For example, the deodorizing filter 45*a* may include at least one of a ceramic filter, a photocatalytic filter, and an activated carbon filter.

A sterilizing device 49 may be further disposed inside the care room 30 and/or in the first duct 100*a*. The sterilizing device 49 may remove bacteria contained in air. The sterilizing device 49 may include at least one of an ultraviolet lamp, an ultraviolet LED, a xenon lamp, an ozone generator and a disinfectant spray.

A drain tank 48 may be disposed at a lower portion of the main body 10, that is, at a lower portion of the machine room 32. The drain tank 48 may store condensed water generated by the evaporator 42. That is, the air flowed out of the care room 30 may be cooled and dehumidified in the evaporator 42 provided in the duct 100*a*, and condensed water generated during cooling and dehumidification may be collected in the drain tank 48. The drain tank 48 may be separable from the main body 10. The drain tank 48 may be referred to as the water collection tank 48.

At least one shelf 90 may be provided in the care room 30. Shoes may be disposed on the shelf 90. The shelf 90 may also include a duct shelf 91. The duct shelf 91 may form a duct flow path 91*b* therein and may include a lower hole 91*a* formed on a lower surface thereof. Air blown from the first blower fan 47 through the second duct 102 may be discharged into the care room 30 through the lower hole 91*a* of the duct shelf 91. An upper hole 93 may also be provided on an upper surface of the duct shelf 91.

A side surface of the duct shelf 91 may be connected to a circulation duct 92 disposed inside the second duct 102. Air may be discharged into the care room 30 through a nozzle 92*a* of the circulation duct 92. Air may be supplied to the duct shelf 91 after passing through the circulation duct 92. The circulation duct 92 may have various shapes.

The temperature sensor 120 may include a first temperature sensor 121 and a second temperature sensor 122. The first temperature sensor 121 may measure a first temperature of air heated by the condenser 200. For example, the first temperature sensor 121 may be disposed downstream of the condenser 200 to sense a temperature of air flowing out of the condenser 200. Hereinafter, a temperature of air measured by the first temperature sensor 121 is defined as the first temperature. The first temperature sensor 121 may be provided on a flow path between the condenser 200 and the first blower fan 47. However, the position of the first temperature sensor 121 is not limited to the above example. A controller 300 of the shoe care apparatus 1 may control an operating frequency and/or an operating rate of the compressor 41 based on the first temperature measured by the first temperature sensor 121.

The second temperature sensor 122 may measure a temperature of air at the air inlet 60 of the care room 30 and/or a temperature of air before the air is introduced into the evaporator 42. For example, the second temperature sensor 122 may be disposed upstream of the evaporator 42 to sense the temperature of air before being introduced into the evaporator 42. The second temperature sensor 122 may be provided on a flow path between the air inlet 60 and the deodorizing filter 45*a* or between the deodorizing filter 45*a* and the evaporator 42. Hereinafter, a temperature of air measured by the second temperature sensor 122 is defined as a second temperature. The controller 300 of the shoe care apparatus 1 may determine an outside air temperature based on the second temperature measured by the second temperature sensor 122 when the shoe care apparatus 1 starts operating.

Figure 4:
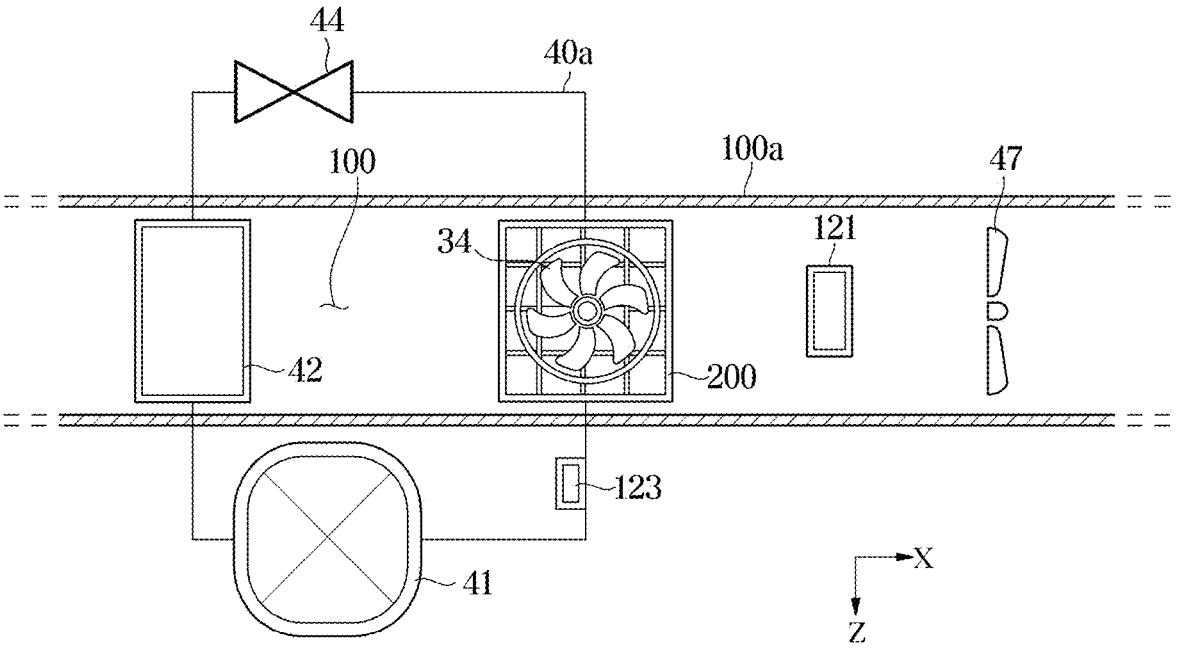
FIGS. 4 and 5 are diagrams illustrating example configurations of the shoe care apparatus illustrated in FIG. 1 according to various embodiments.
Figure 5:
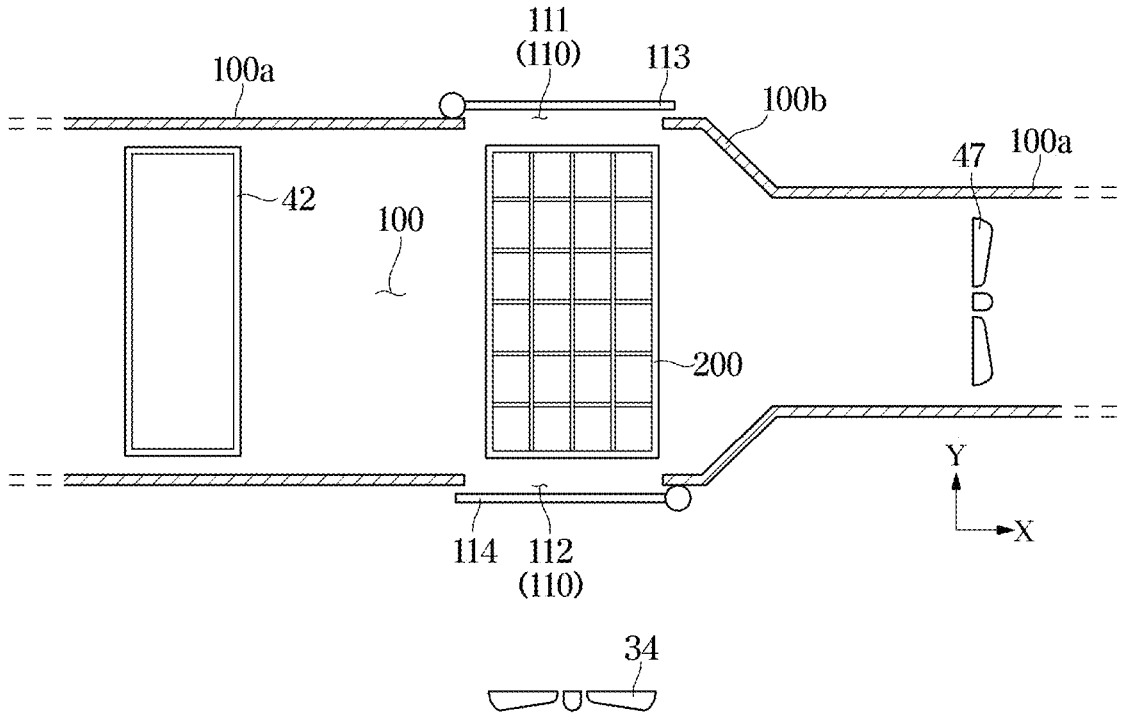

FIGS. 4 and 5 are diagrams illustrating example configurations of the shoe care apparatus illustrated in FIG. 1 according to various embodiments. Air passing through the condenser in the shoe care apparatus illustrated in FIG. 3 will be described in greater detail below with reference to FIGS. 4 and 5.

Referring to FIGS. 4 and 5, the shoe care apparatus according to an embodiment of the present disclosure may include the heat pump device 40, the flow paths 100 and 110, the duct 100*a*, the sensor 120, and blower fans 34 and 47.

The heat pump device 40 may include the compressor 41, the evaporator 42, the condenser 200, and the expander 44. The compressor 41, the evaporator 42, the condenser 200, and the expander 44 may be connected through the refrigerant pipe 40*a*. The evaporator 42 may cool and/or dehumidify air within the circulation flow path 100. The condenser 200 may be heated by the flow of air passed through the evaporator 42.

The flow paths 100 and 110 may include the circulation flow path 100 and the condenser cooling flow path 110. The circulation flow path 100 may communicate with the care room 30 so that air discharged into the care room 30 passes through the evaporator 42 and the condenser 200 and then is supplied back to the care room 30. The circulation flow path 100 may be formed within the duct 100*a*. The circulation flow path 100 may be formed inside the machine room 32. Air in the circulation flow path 100 may be blown by the first blower fan 47. At least a portion of the circulation flow path 100 may extend in the first direction. As illustrated in FIG. 5, air in the circulation flow path 100 may flow in the first direction (e.g., X direction). The circulation flow path 100 may be the first flow path 100. The condenser cooling flow path 110 may be the second flow path 110.

Figure 15:
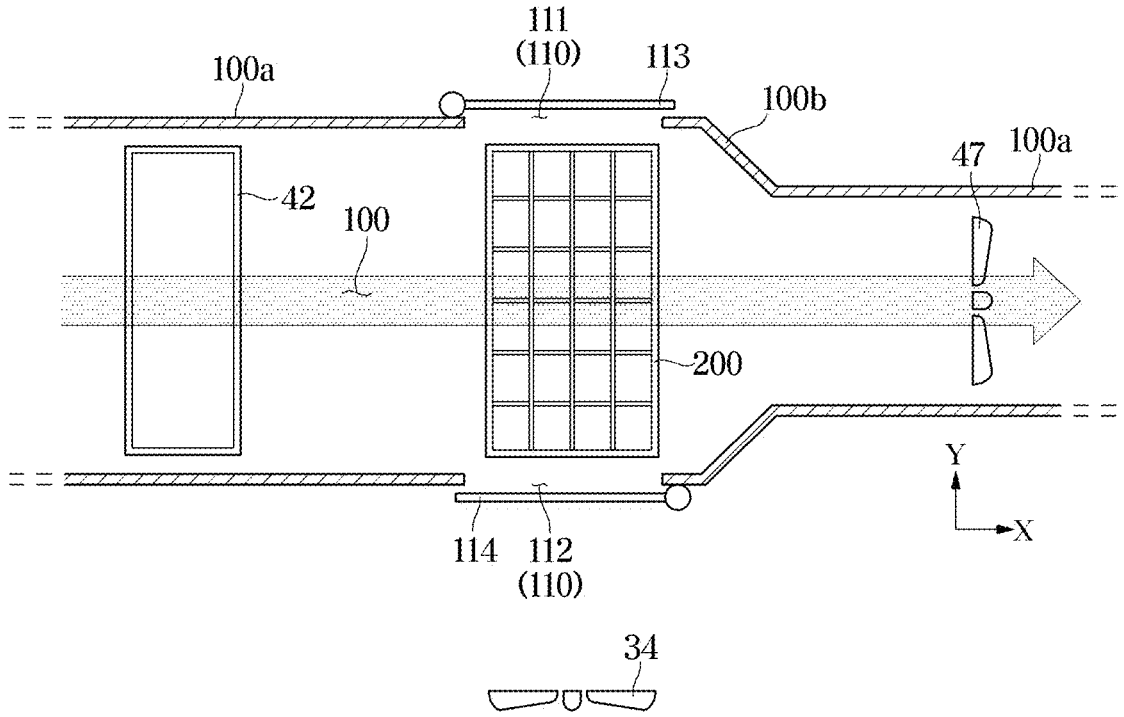
FIG. 15 is a diagram illustrating an air flow when the shoe care apparatus is operated in a first operation mode according to various embodiments.

The air in the care room 30 may flow to the circulation flow path 100 (see FIG. 15). The air flowed through the circulation flow path 100 may pass through the condenser 200 and the evaporator 42. The air passed through the condenser 200 and the evaporator 42 may be introduced back into the care room 30 by being blown by the first blower fan 47. The air in the main body 10, for example, the air circulating through the care room 30 and the circulation flow path 100 may continuously circulate the inside. At this time, heat accumulation may occur in the condenser 200.

The condenser cooling flow path 110 may allow air in the machine room 32 to flow to the condenser 200 disposed in the duct 100*a*. For example, the condenser cooling flow path 110 may allow air outside the duct 100*a* to flow into the condenser 200 within the duct 100*a* within the machine room 32 (see FIG. 16). Air outside the duct 100*a* may flow into the condenser 200 within the duct 100*a* along a second direction. The second direction may be a different direction from the first direction. For example, the second direction (e.g., −Y direction) may be a direction perpendicular to the first direction. However, the second direction is not limited to the above example.

The shoe care apparatus 1 may further include the second blower fan 34. The second blower fan 34 may blow air in the machine room 32 so that the air flows through the condenser cooling flow path 110. The second blower fan 34 may be disposed inside the machine room 32. The second blower fan 34 may be disposed downstream of the condenser 200 on the condenser cooling flow path 110 and/or in front of the condenser 200 within the machine room 32. However, the position of the second blower fan 34 is not limited to the above example or as shown in the drawings.

The condenser cooling flow path 110 may include an inlet 111 and an outlet 112. The inlet 111 and the outlet 112 may be formed on different surfaces (or walls) of the duct 100*a*, respectively. For example, the inlet 111 and the outlet 112 may penetrate opposite surfaces of the duct 100*a*, and the inlet 111 may be formed on a rear side of the duct 100*a* and the outlet 112 may be formed on a front side of the duct 100*a*.

Air outside the main body 10 may flow into the main body 10 through the communication hole 33 provided on the rear wall 11*e* of the outer case. The communication hole 33 may allow communication between the outside of the main body 10 and the machine room 32. Air introduced into the machine room 32 through the communication hole 33 may flow into the condenser 200 disposed in the duct 100*a* through the inlet 111. The air passed through the condenser 200 may exchange heat with the condenser 200 and flow back into the machine room 32 through the outlet 112. The air flowed into the machine room 32 through the outlet 112 may flow out of the main body again through the communication hole 33. At this time, air in the condenser cooling flow path 110, that is, air outside the main body 10, rather than air in the circulation flow path 100, may flow in the condenser 200. Accordingly, the heat accumulated in the condenser 200 may be transferred to the air in the condenser cooling flow path 110 and then discharged to the outside of the main body 10. Because the heat accumulated in the condenser 200 is discharged, the heat exchange efficiency of the heat pump device 40 may be increased. A detailed description of this will be provided later.

The shoe care apparatus may further include dampers 113 and 114. The dampers 113 and 114 may open and close the condenser cooling flow path 110. A plurality of the dampers 113 and 114 may be provided. The plurality of dampers 113 and 114 may include the first damper 113 provided to open and close the inlet 111 and the second damper 114 provided to open and close the outlet 112. The plurality of dampers 113 and 114 may be controlled by the controller 300. A detailed description of this will be provided later.

The duct 100*a* may include a guide portion 100*b*. The guide portion 100*b* may be formed to be inclined to guide air passing through the condenser 200 and flowing toward the first blower fan 47 within the duct 100*a*. For example, the guide portion 100*b* may be inclined such that a cross-sectional area of the circulation flow path 100 is reduced so that a flow rate of air flowing in the first direction within the circulation flow path 100 increases.

The temperature sensor 120 of the shoe care apparatus may further include a third temperature sensor 123. The third temperature sensor 123 may sense a temperature of the refrigerant flowing through the refrigerant pipe 40*a* and/or a temperature of the machine room 32 around the heat pump device 40. For example, the third temperature sensor 123 may sense a temperature of the condenser 200. Hereinafter, a temperature of air measured by the third temperature sensor 123 is defined as a third temperature.

Figure 6:
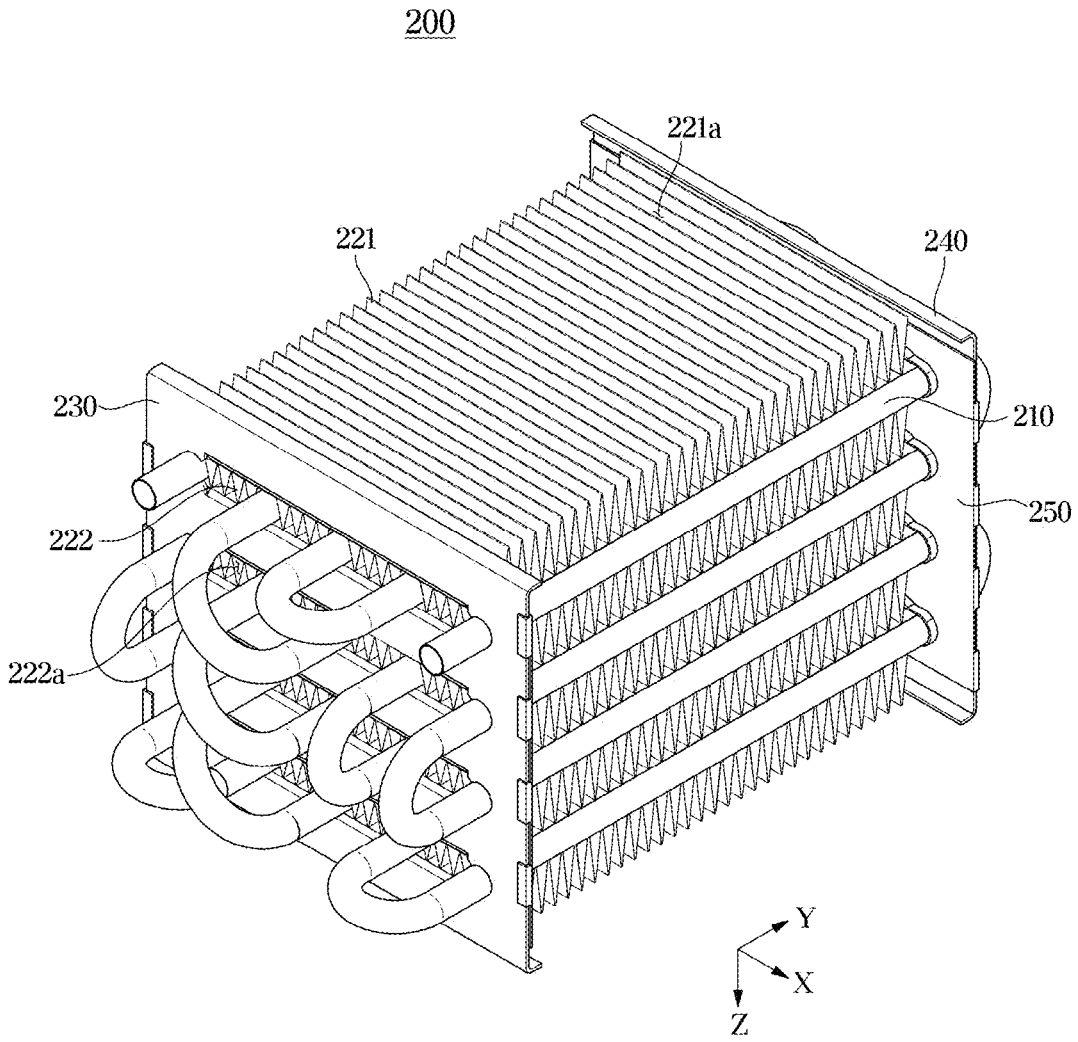
FIG. 6 is a perspective view illustrating a condenser in the shoe care apparatus illustrated in FIG. 1 according to various embodiments.
Figure 7:
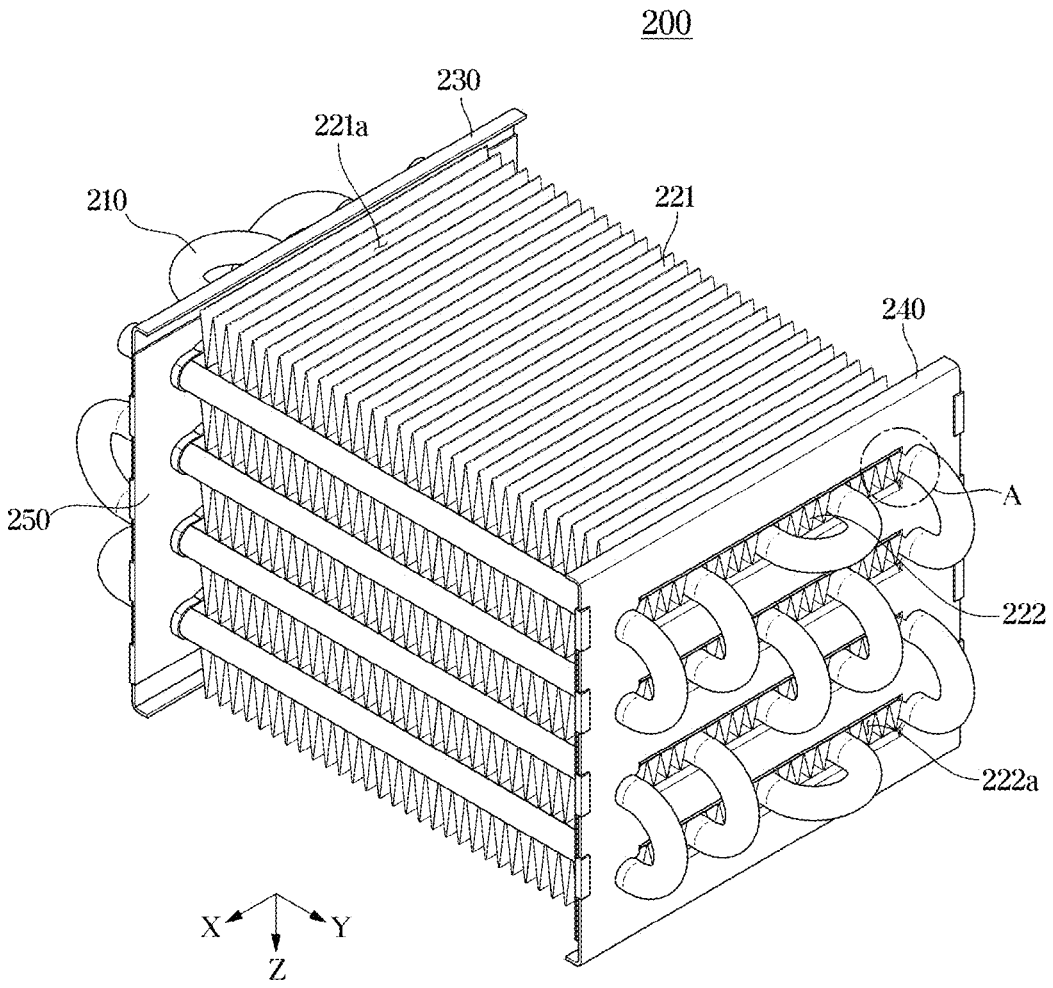
FIG. 7 is a perspective view of the condenser illustrated in FIG. 6, viewed from another angle according to various embodiments.
Figure 8:
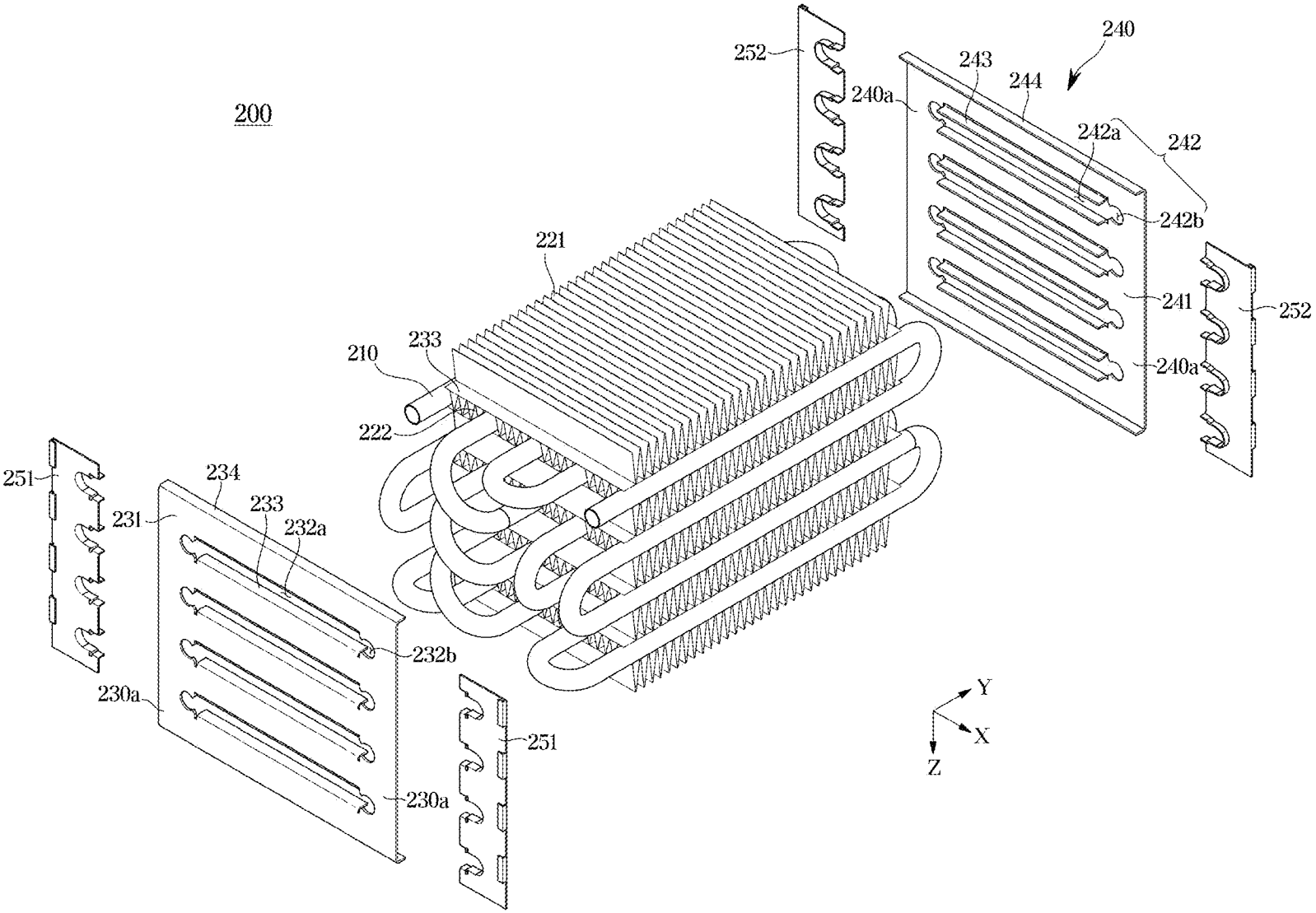
FIG. 8 is an exploded perspective view of the condenser illustrated in FIG. 6 according to various embodiments.

FIG. 6 is a perspective view illustrating a condenser in the shoe care apparatus illustrated in FIG. 1 according to various embodiments. FIG. 7 is a perspective view of the condenser illustrated in FIG. 6, viewed from another angle according to various embodiments. FIG. 8 is an exploded perspective view of the condenser illustrated in FIG. 6 according to various embodiments.

Referring to FIGS. 6, 7 and 8 (which may be referred to as FIGS. 6 to 8), the condenser 200 of the shoe care apparatus according to an embodiment of the present disclosure may include a refrigerant pipe 210, heat exchange fins 220, covers 230 and 240, and a sealing member 250.

The refrigerant pipe 210 is connected to the refrigerant pipe 40*a* of the heat pump device 40 so that the refrigerant flowed within the heat pump device 40 may flow therein. The refrigerant flowing within the refrigerant pipe 210 may exchange heat with air flowing through the condenser 200.

The heat exchange fins 220 may include first heat exchange fins 221 and second heat exchange fins 222. The first heat exchange fins 221 may form a portion of the circulation flow path 100 so that air flowing through the circulation flow path 100 flows therethrough. The second heat exchange fins 222 may form a portion of the condenser cooling flow path 110 so that air outside the duct 100*a* passes through the condenser 200 within the duct 100*a*. The first heat exchange fins 221 and the second heat exchange fins 222 may be stacked such that the airs flow in different directions from each other. For example, the first heat exchange fins 221 may allow air to flow in a first direction, and the second heat exchange fins 222 may allow air to flow in a second direction. The first direction and the second direction may be directions perpendicular to each other. However, the first direction and the second direction are not limited to the above example.

The shoe care apparatus may further include a separation panel 233. The separation panel 233 may be disposed between the first heat exchange fins 221 and the second heat exchange fins 222. For example, the first heat exchange fins 221, the separation panel 233, and the second heat exchange fins 222 may be arranged along a vertical direction. The separation panel 233 may be formed to correspond to the heat exchange fins 221 and 222 so that passages 221*a* formed in the first heat exchange fins 221 and passages 222*a* formed in the second heat exchange fins 222 are separated.

The covers 230 and 240 may cover a portion of the condenser 200. For example, the covers 230 and 240 may cover the heat exchange fins 220. The covers 230 and 240 may have a substantially square shape. The covers 230 and 240 may include the first cover 230 and the second cover 240. The first cover 230 may cover one side of the condenser 200 in the second direction, and the second cover 240 may cover the other side of the condenser 200 in the second direction. The first cover 230 and the second cover 240 may be disposed on opposite sides. The first cover 230 and the second cover 240 may be coupled to the duct 100*a*.

The sealing member (e.g., a seal) 250 may seal a space between the covers 230 and 240, the refrigerant pipe 210, and/or the heat exchange fins 220. The sealing member 250 may include a first sealing member 251 and a second sealing member 252. The first sealing member 251 may cover a side 230*a* of the first cover 230. The second sealing member 252 may cover a side 240*a* of the second cover 240.

The covers 230 and 240 may include cover portions 231, 234, 241, and 244, openings 232 and 242, and bent portions 233 and 243.

The cover portions 231, 234, 241, and 244 may include the first cover portions 231 and 241 provided to cover opposite ends of the heat exchange fins 220 in the second direction, and the second cover portions 234 and 244 provided to cover an upper portion of the heat exchange fin 220 positioned at the most upper end and/or a lower portion of the heat exchange fin 220 positioned at the most lower end. The second cover portions 234 and 244 may extend from an upper and/or lower ends of the first cover portions 231 and 241 to cover a portion of the heat exchange fins 220.

The openings 232 and 242 may be opened on the first cover portions 231 and 241. The openings 232 and 242 may extend along the first direction. For example, the openings 232 and 242 may extend in left and right directions. The openings 232 and 242 may include first opening portions 232*a* and 242*a* through which air flowing through the condenser cooling flow path 110 passes through the covers 230 and 240, and second opening portions 232*b* and 242*b* into which the refrigerant pipe 210 is inserted. The second opening portions 232*b* and 242*b* may be provided on opposite sides of the first opening portions 232*a* and 242*a*. The refrigerant pipe 210 may penetrate the first opening portions 232*a* and 242*a* and the second opening portions 232*b* and 242*b*.

The bent portions 233 and 243 may be bent from the first cover portions 231 and 241 to form the openings 232 and 242. For example, the bent portions 233 and 243 may be bent from the first cover portions 231 and 241 to form first opening portions 232*a* and 242*a*. The bent portions 233 and 243 may be bent in a direction toward the heat exchange fins 220 from the first cover portions 231 and 241. The bent portions 233 and 243 may extend in the same direction as the second cover portions 234 and 244.

Figure 9:
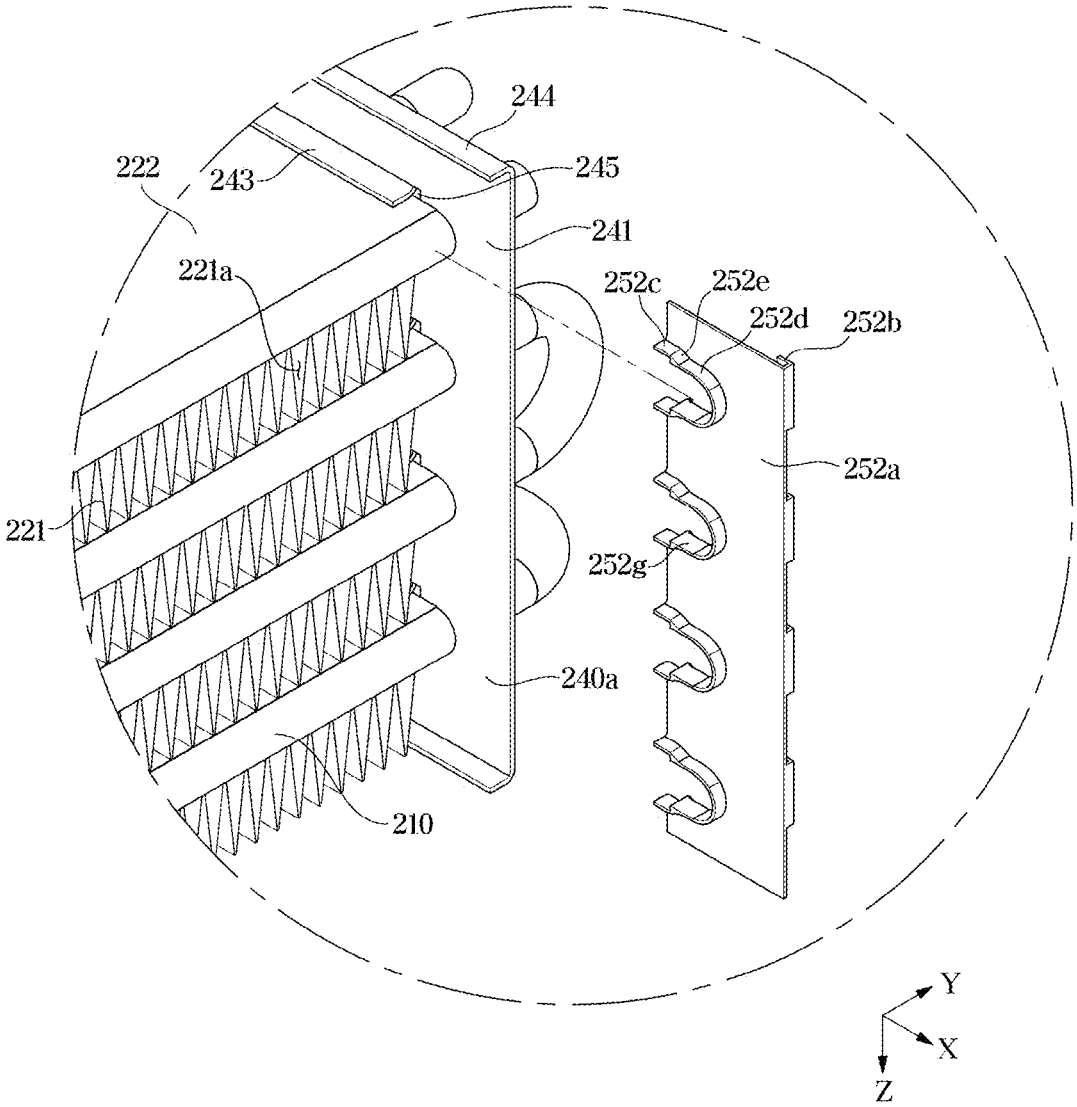
FIG. 9 is a partial exploded perspective view of the condenser illustrated in FIG. 6 according to various embodiments.
Figure 10:
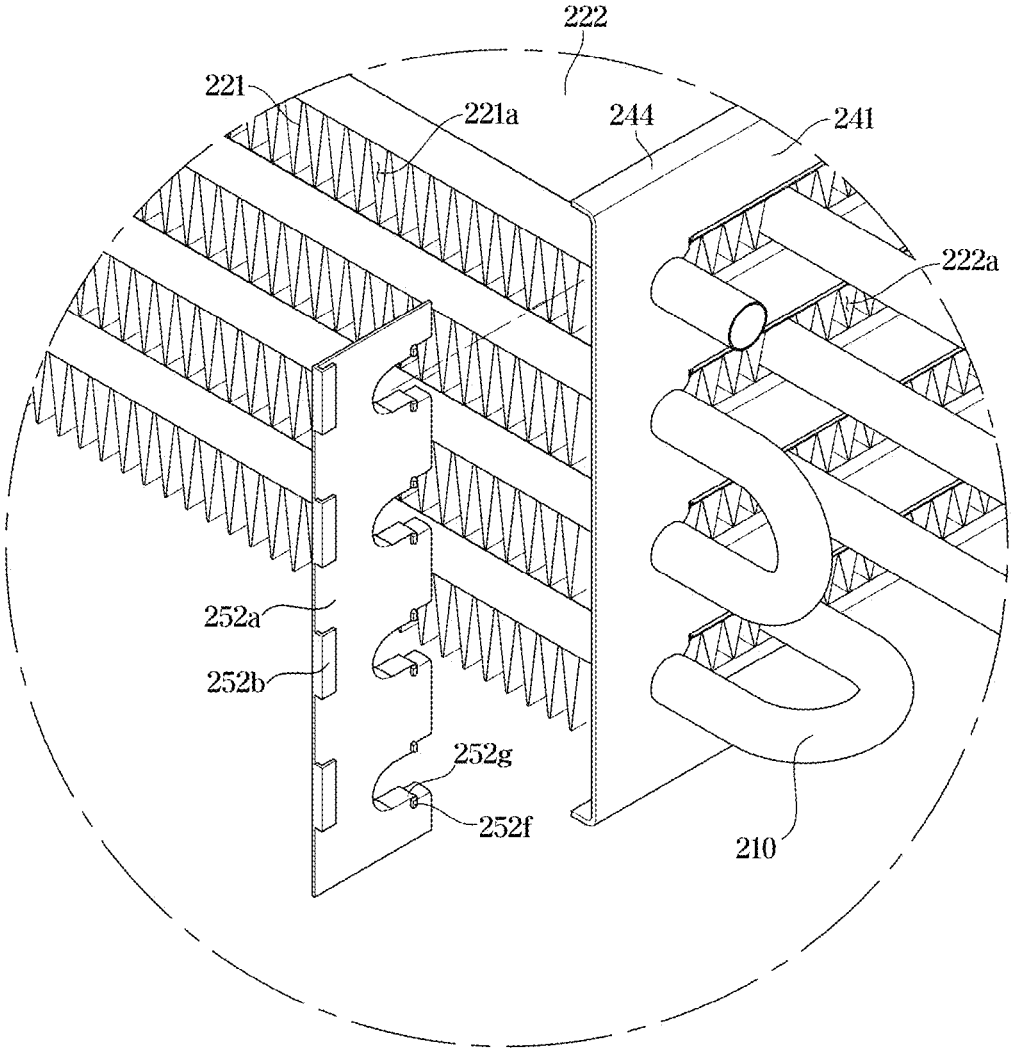
FIG. 10 is a partial exploded perspective view of the condenser illustrated in FIG. 9, viewed from another angle according to various embodiments.
Figure 11:
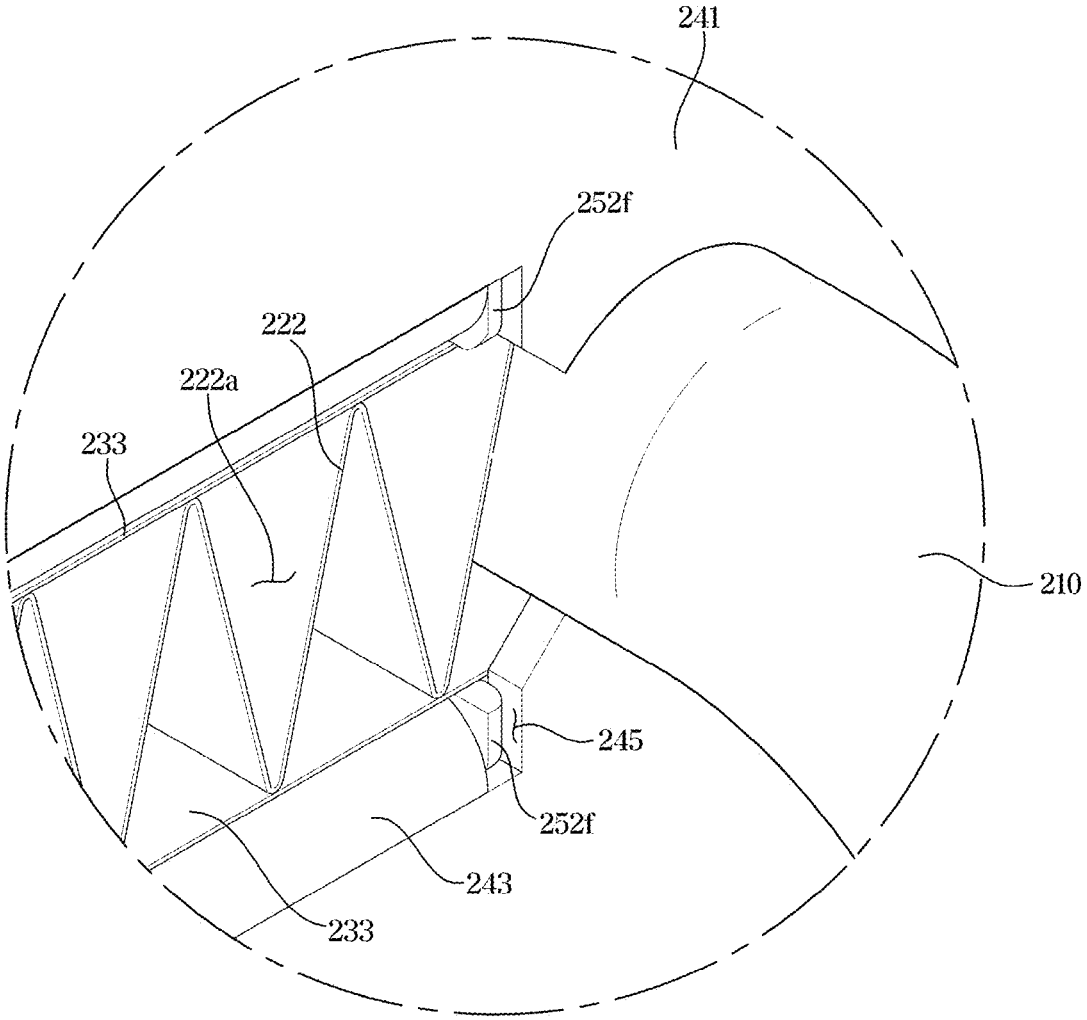
FIG. 11 is an enlarged perspective view of a portion of the condenser illustrated in FIG. 7 according to various embodiments.

FIG. 9 is a partial exploded perspective view of a part of the condenser illustrated in FIG. 6 according to various embodiments. FIG. 10 is a partial exploded perspective view of the condenser illustrated in FIG. 9, viewed from another angle according to various embodiments. FIG. 11 is an enlarged perspective view of the condenser illustrated in FIG. 7 according to various embodiments. FIG. 11 is an enlarged view of part A in FIG. 7. The second cover and the second sealing member will be described in greater detail below with reference to FIGS. 9, 10 and 11 (which may be referred to as FIGS. 9 to 11).

Referring to FIGS. 9 to 11, the condenser 200 of the shoe care apparatus according to an embodiment of the present disclosure may include the cover 240 and the sealing member 252 mounted on the cover 240.

The opening 242 of the cover may correspond to the passage 222*a* of the second heat exchange fin 222 so that air flowing through the condenser cooling flow path 110 flows therethrough. The bent portion 243 may extend in the second direction (e.g., −Y direction) to form the opening 242. For example, the bent portion 243 extends in the second direction, and one surface of the bent portion 243 may be in contact with the second heat exchange fin 222. In this case, as the bent portion 243 is formed, a hole 245 may be formed between the opening 242, the refrigerant pipe 210, and the second heat exchange fin 222.

The sealing member 252 may be mounted on and/or coupled to the side 240*a* of the cover. The sealing member 252 may include a base 252*a*, a cover coupling portion 252*b*, sealing portions 252*c*, 252*d*, and 252*e*, a sealing surface 252*g*, and a sealing protrusion 252*f*.

The cover coupling portion 252*b* may be formed at one end of the sealing member 252 in the first direction. The cover coupling portion 252*b* may include a hook shape. The side 240*a* of the cover may be disposed between the cover coupling portions 252*b*. The cover coupling portion 252*b* may protrude from the base 252*a* toward the rear. However, the shape of the cover coupling portion 252*b* is not limited to those illustrated in the above example and/or drawings.

The sealing portions 252*c*, 252*d*, and 252*e* may be formed to correspond to the refrigerant pipe 210, the second heat exchange fin 222, and the bent portion 243. The sealing portions 252*c*, 252*d*, and 252*e* may include the first sealing portion 252*c*, the second sealing portion 252*d*, and the third sealing portion 252*e*. The first sealing portion 252*c* may be formed to correspond to the bent portion 243. When the sealing member 252 is coupled to the cover 240, the first sealing portion 252*c* may cover the surface opposite to a surface of the bent portion 243 coming into contact with the second heat exchange fin 222. The second sealing portion 252*d* may cover a circumference of the refrigerant pipe 210. For example, the second sealing portion 252*d* may cover a circumference that is not in contact with the second heat exchange fin 222. The third sealing portion 252*e* may be provided between the first sealing portion 252*c* and the second sealing portion 252*d*. The bent portion 243 and the second heat exchange fin 222 may have a step, and the third sealing portion 252*e* may cover the step between the bent portion 243 and the second heat exchange fin 222.

The sealing portions 252*c*, 252*d*, and 252*e* may form the sealing surface 252*g* in contact with the refrigerant pipe 210, the second heat exchange fin 222, and the bent portion 243. The sealing surface 252*g* may be formed to correspond to the refrigerant pipe 210, the second heat exchange fin 222, and the bent portion 243.

The sealing protrusion 252*f* may seal the hole 245 formed on the cover 240 when the sealing member 252 is coupled to the cover 240. The sealing protrusion 252*f* may protrude rearward from the base 252*a*. The sealing protrusion 252*f* may be formed adjacent to the sealing surface 252*g*. A plurality of the sealing protrusions 252*f* may be provided above and below the sealing surface 252*g*.

Due to the hole 245 provided between the opening 242, the refrigerant pipe 210, and the second heat exchange fin 222, air flowing in the second direction may pass through the condenser 200 and flow within the circulation flow path 100 rather than flowing to the outside of the duct 100*a*. For example, air flowing into the opening 242 of the second cover 240, instead of flowing to the circulation flow path 100, must pass through the flow paths 222*a* between the second heat exchange fins 222, pass through the opening 232 of the first cover 230, and flow to the outside of the duct 100*a*. However, air passing through the hole 245 of the opening 242 of the second cover 240 may flow to the circulation flow path 100 without passing through the flow paths 222*a* between the second heat exchange fins 222. Therefore, the effect of eliminating heat accumulation in the condenser 200 may be reduced. However, because the sealing protrusion 252*f* seals the hole 245, air flowing into the hole 245 may be minimized and/or reduced, and the heat exchange efficiency of the heat pump device 40 may be increased.

Figure 12:
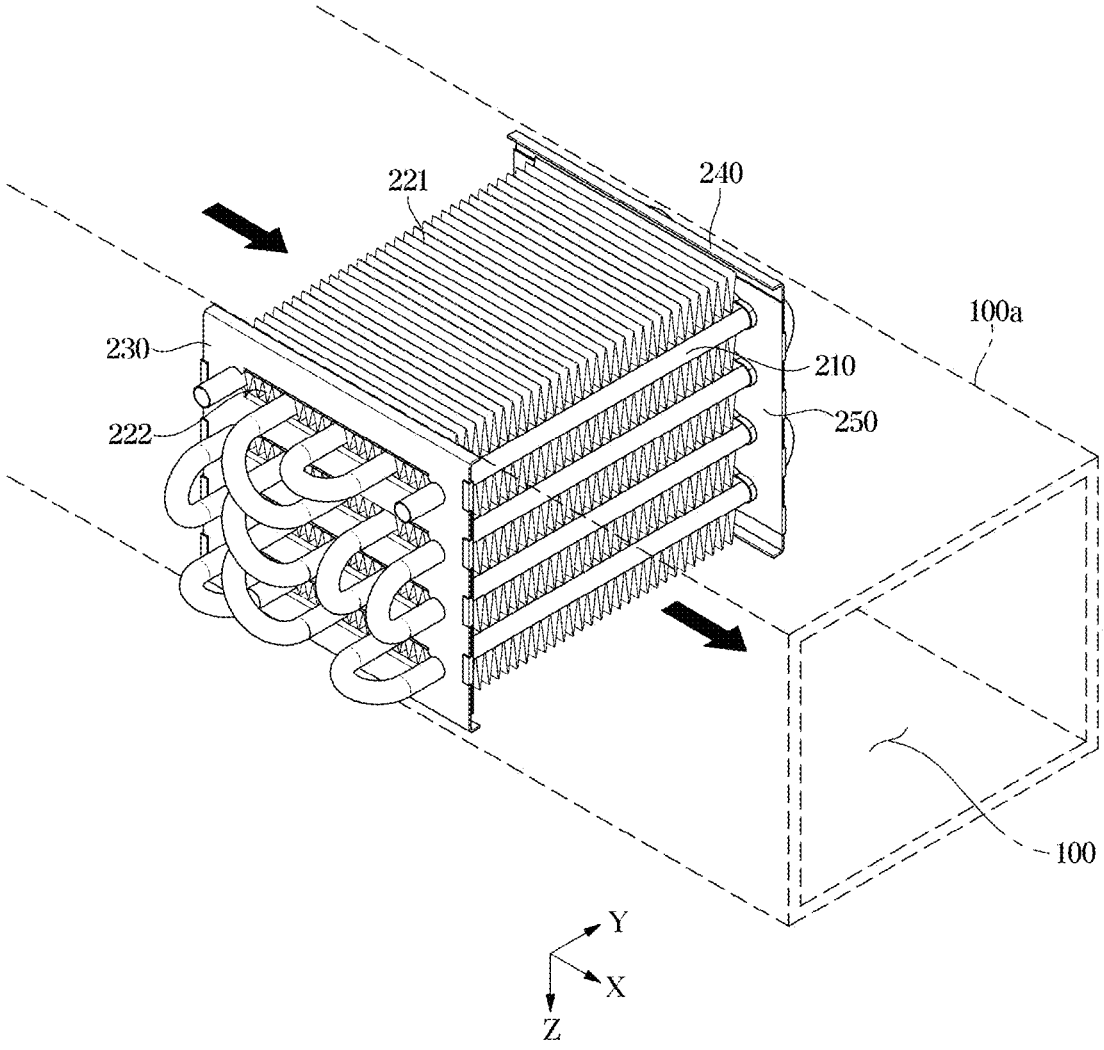
FIG. 12 is a perspective view illustrating a state in which the condenser is disposed within a duct in the shoe care apparatus illustrated in FIG. 1 according to various embodiments.

FIG. 12 is a perspective view illustrating a state in which the condenser is disposed within a duct in the shoe care apparatus illustrated in FIG. 1 according to various embodiments.

Referring to FIG. 12, at least a portion of the condenser 200 of the shoe care apparatus according to an embodiment of the present disclosure may be disposed within the duct 100*a*. For example, the covers 230 and 240 may be coupled with the duct 100*a*. The passage 221*a* of the first heat exchange fin 221 may be a portion of the circulation flow path 100. A portion of the circulation flow path 100 may extend in the first direction (e.g., X direction) within the duct 100*a*.

In the drawing, the duct 100*a* extends in the first direction, but the shape of the duct 100*a* is not limited to that illustrated in the drawing, and as illustrated in FIG. 5, the duct 100*a* may be formed to be inclined such that the cross-sectional area of the circulation flow path 100 decreases downstream of the condenser 200, and conversely, the duct 100*a* may be inclined such that the cross-sectional area of the circulation flow path 100 increases.

Figure 13:
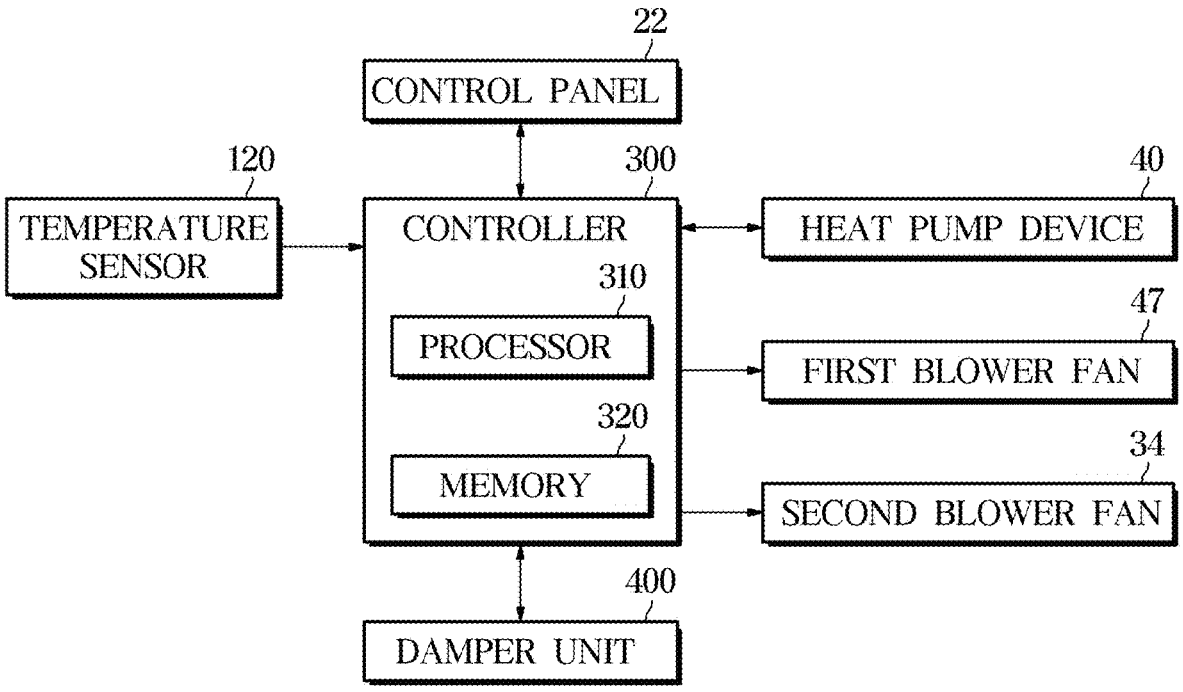
FIG. 13 is a block diagram illustrating an example configuration of the shoe care apparatus according to various embodiments.

FIG. 13 is a block diagram illustrating an example configuration of the shoe care apparatus according to various embodiments.

Referring to FIG. 13, the shoe care apparatus 1 according to an embodiment may include the control panel 22, the first blower fan 47, the second blower fan 34, the heat pump device (e.g., including a heat pump) 40, the temperature sensor 120, the controller (e.g., including processing and/or control circuitry) 300 and a damper unit (e.g., including a damper) 400.

As described above, the control panel 22 may include at least one of buttons and a touch screen, and may receive various commands from the user.

The control panel 22 may transmit a command received from the user (hereinafter referred to as 'user input') to the controller 300.

As described above, the first blower fan 47 may blow air in the circulation flow path 100 in the first direction, and the second blower fan 34 may blow air in the machine room 32 in the second direction so that the air in the machine room 32 passes through the condenser 200.

The first blower fan 47 and/or the second blower fan 34 may be controlled by the controller 300.

The heat pump device 40 may include the compressor 41, the evaporator 42, the condenser 200, and the expansion device 44. The heat pump device 40 may transmit operation information (e.g., the operating frequency of the compressor 41) to the controller 300, and the controller 300 may control the heat pump device 40.

According to various embodiments, the controller 300 may include various processing and/or control circuitry. For example, as used herein, including the claims, the term "processor" and/or "controller" may include various processing and/or control circuitry, including at least one processor and/or controller, wherein one or more of at least one processor and/or controller may be configured to perform various functions described herein. Additionally, the at least one processor and/or controller may include a combination of processors and/or controllers performing various of the recited/disclosed functions. At least one processor and/or controller may execute program instructions to achieve or perform various functions. The controller 300 may be configured to control the operating frequency and/or operating rate of the compressor 41.

The temperature sensor 120 may sense a temperature at each location of the shoe care apparatus 1.

For example, the temperature sensor 120 according to an embodiment may include at least one of the first temperature sensor 121, the second temperature sensor 122, and the third temperature sensor 123.

The temperature sensor 120 may sense the temperature at each location of the shoe care apparatus 1 and transmit a signal to the controller 300.

For example, the temperature sensor 120 may transmit at least one of information on a first temperature measured by the first temperature sensor 121, information on the second temperature measured by the second temperature sensor 122, and information on a third temperature measured by the third temperature sensor 123, to the controller 300.

The damper unit 400 may include at least one of the first damper 113 to open and close the inlet 111 and the second damper 114 to open and close the outlet 112.

The controller 300 may control the opening and closing of the damper unit 400. As an example, the controller 300 may control the opening and closing of the first damper 113 and/or the second damper 114.

According to various embodiments, the shoe care apparatus 1 may omit any one of the components illustrated in FIG. 13.

For example, the shoe care apparatus 1 may not include the damper unit 400.

The controller 300 may include at least one processor 310 including various processing circuitry. For example, as used herein, including the claims, the term "processor" may include various processing circuitry, including at least one processor, wherein one or more of at least one processor may be configured to perform various functions described herein. Additionally, the at least one processor may include a combination of processors performing various of the recited/disclosed functions. At least one processor may execute program instructions to achieve or perform various functions. The controller 300 may also include at least one memory 320, and may control at least one other component of the shoe care apparatus 1.

The processor 310 may control, for example, at least one other component (e.g., the heat pump device 40, damper unit 400, second blower fan 34, and/or first blower fan 47) of the shoe care apparatus 1 connected to the processor 310 by, for example, and without limitation, executing software (e.g., a program), and may perform various data processing or operations. According to an embodiment, as at least part of data processing or operations, the processor 310 may store instructions or data received from other components (e.g., the temperature sensor 120 and the control panel 22) in a volatile memory, process instructions or data stored in the volatile memory, and store the resulting data in a non-volatile memory. According to an embodiment, the processor 310 may include a main processor (e.g., a central processing unit) or an auxiliary processor (e.g., a processor for controlling the heat pump device, a processor for controlling the damper unit) that may operate independently or together with the main processor. For example, when the processor 310 includes a main processor and an auxiliary processor, the auxiliary processor may be set to use less power than the main processor or to specialize in designated functions. The coprocessor may be implemented separately from the main processor or as a part of the main processor.

The memory 320 may store various data used by at least one component (e.g., the processor 310 or the temperature sensor 120) of the shoe care apparatus 1. The data may include, for example, input data or output data for software and instructions related thereto. The memory 320 may include a volatile memory or a non-volatile memory.

According to various embodiments, the memory 320 may store software (e.g., a program) that performs operations, which will be described later, when executed by the processor 310.

While the configuration and structure of the shoe care apparatus 1 according to various embodiments have been described above, an example control method of the shoe care apparatus 1 according to various embodiments will be described in greater detail below.

Figure 14:
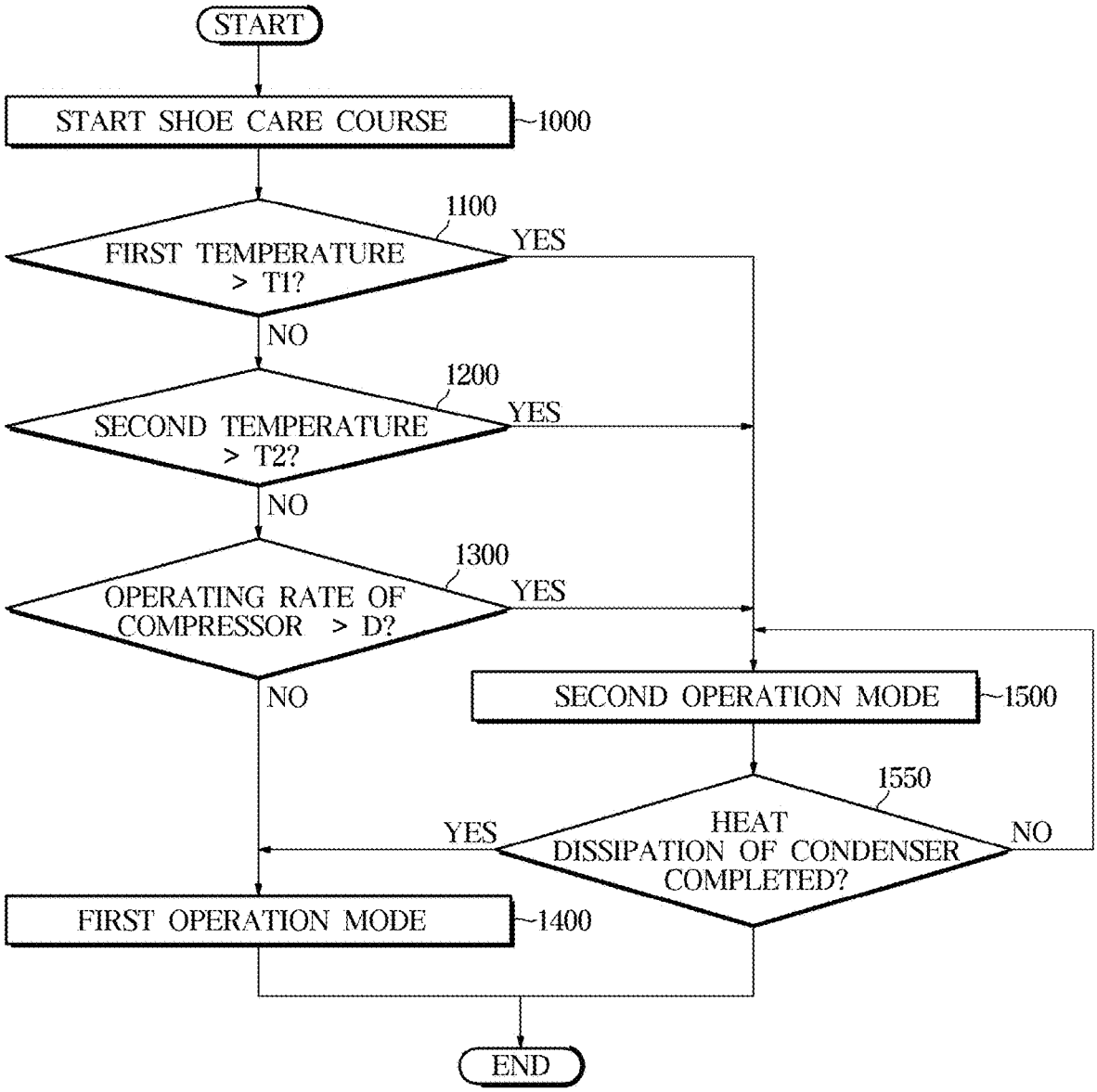
FIG. 14 is a flow chart illustrating an example method of controlling the shoe care apparatus according to various embodiments.
Figure 16:
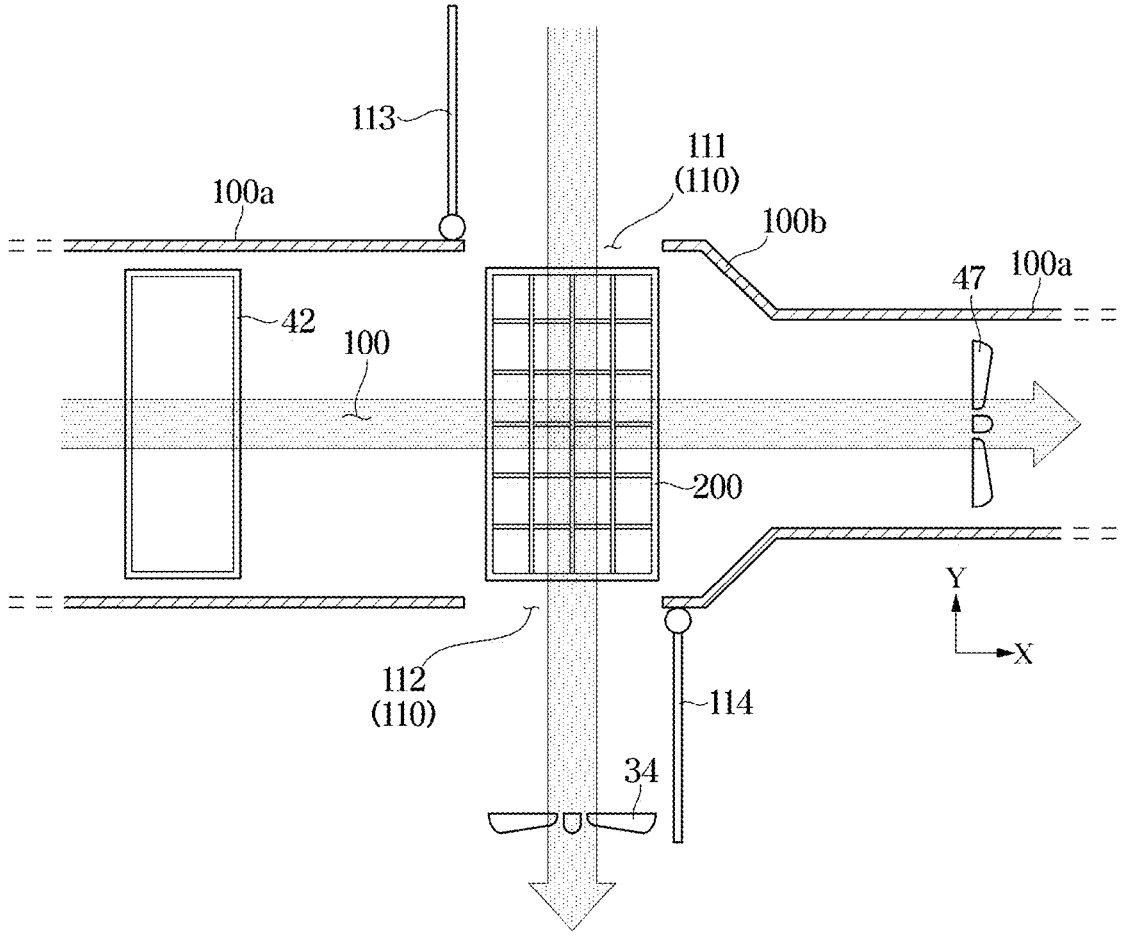
FIG. 16 is a diagram illustrating an air flow when the shoe care apparatus is operated in a second operation mode according to various embodiments.

FIG. 14 is a flowchart illustrating an example method of controlling the shoe care apparatus according to various embodiments, FIG. 15 is a diagram illustrating an air flow when the shoe care apparatus is operated in a first operation mode according to various embodiments, and FIG. 16 is a diagram illustrating an air flow when the shoe care apparatus is operated in a second operation mode according to various embodiments.

Referring to FIG. 14, the controller 300 and/or processor 310 may determine an operation mode of the shoe care apparatus 1 based on at least one of a temperature of air to be supplied to the care room 30 (first temperature), an outside air temperature (second temperature), a temperature of air in the machine room 32 (third temperature), and operation information of the compressor 41.

The operation mode of the shoe care apparatus 1 may include a first operation mode and a second operation mode.

The first operation mode, may refer to a normal mode, and may refer to an operation mode for drying shoes accommodated in the care room 30 with high temperature air that has passed through the condenser 200.

The second operation mode may refer to an operation mode for cooling the condenser 200.

According to various embodiments, the first operation mode and the second operation mode may be classified depending on whether the second blower fan 34 operates or whether the damper unit 400 is opened or closed.

For example, in an embodiment, when the second blower fan 34 operates, this may refer to the shoe care apparatus 1 operating in the second operation mode, and when the second blower fan 34 does not operate, this may refer to the shoe care apparatus 1 operating in the first operation mode. In an embodiment, when the damper unit 400 is opened, this may refer to the shoe care apparatus 1 operating in the second operation mode, and when the damper unit 400 is closed, this may refer to the shoe care apparatus 1 operating in the first operation mode.

According to various embodiments, based on start of the shoe care course selected by the user through the control panel 22 (1000), the controller 300 may control each component (e.g., the heat pump device 40 and/or the first blower fan 47) of the shoe care apparatus 1 using an algorithm corresponding to the selected shoe care course.

In an embodiment, when no condition is satisfied (NO of 1100, NO of 1200, and NO of 1300), the controller 300 may determine the operation mode of the shoe care apparatus 1 to be the first operation mode, which is the normal mode (1400).

Referring to FIG. 15, in the first operation mode, the first blower fan 47 may operate and the second blower fan 34 may not operate. In addition, in the case of the shoe care apparatus 1 including the damper unit 400, the damper unit 400 may be closed in the first operation mode.

That is, the controller 300 may operate the first blower fan 47 and stop the operation of the second blower fan 34 in the first operation mode. According to various embodiments, the controller 300 may close the first damper 113 and/or the second damper 114 in the first operation mode.

In the first operation mode, the air in the machine room 32 does not pass through the condenser 200, and only the air in the circulation flow path 100 passes through the condenser 200 to be supplied to shoes.

In the first operation mode, the controller 300 may control the heat pump device 40 so that the first temperature follows a target temperature T1 corresponding to the course selected by the user. For example, the controller 300 may adjust the operating frequency and/or operating rate (on/off duty) of the compressor 41 through a fuzzy control method to follow the target temperature T1 corresponding to the care course.

In a case in which the first temperature continues to rise even though the compressor 41 operates at a preset frequency (e.g., minimum operating frequency) or operates at a preset operating rate (e.g., minimum operating rate) due to special circumstances (e.g., high temperature outside air), due to high temperature and humidity air, dehumidification performance of the shoe care apparatus 1 may be reduced and the heat pump device 40 may malfunction.

In order to address this problem, the shoe care apparatus 1 according to various embodiments may operate in the second operation mode for cooling the condenser 200 based on a preset condition being satisfied while the shoe care course selected by the user is in progress (YES in 1100, YES in 1200, and YES in 1300).

In an embodiment, the controller 300 may determine the operation mode of the shoe care apparatus as the second operation mode (1500) based on a temperature (first temperature) of air to be supplied to the care room 30 being greater than or equal to the first preset temperature T1 (YES in 1100).

This is because it may be assumed that the dehumidification performance of the shoe care apparatus 1 has been reduced due to high temperature and humidity air when the first temperature is higher than the first preset temperature T1, and accordingly, cooling of the condenser 200 is required.

In this case, the first preset temperature T1 may be set to correspond to the care course selected by the user.

As another example, the controller 300 may determine the operation mode of the shoe care apparatus 1 as the second operation mode (1500) based on a temperature of the outside air (second temperature) being greater than or equal to a second preset temperature T2 (YES in 1200). In this case, the second preset temperature T2 may be set regardless of the care course selected by the user.

This is because the dehumidification performance of the shoe care apparatus 1 may be reduced due to high temperature and humidity outside air when the second temperature is higher than the second preset temperature T2, and accordingly, cooling of the condenser 200 is required.

As another example, the controller 300 may determine the operation mode of the shoe care apparatus 1 as the second operation mode (1500) based on the operating rate of the compressor 41 being less than or equal to a preset operating rate D (YES in 1300). The preset operating rate D may, for example, refer to the minimum operating rate of the compressor.

This is because it may be assumed that the dehumidification performance of the shoe care apparatus 1 has been reduced due to high temperature and humidity air when the operating rate of the compressor 41 is lower than the preset operating rate D, and accordingly, cooling of the condenser 200 is required.

According to various embodiments, the controller 300 may determine the operation mode of the shoe care apparatus 1 as the second operation mode (1500) based on the operating frequency of the compressor 41 being less than or equal to the preset frequency (e.g., the minimum operating frequency of the compressor).

Referring to FIG. 16, both the first blower fan 47 and the second blower fan 34 may operate in the second operation mode. According to various embodiments, only the second blower fan 34 may operate in the second operation mode. In addition, in the case of the shoe care apparatus including the damper unit 400, the damper unit 400 may be opened in the second operation mode.

That is, the controller 300 may operate the first blower fan 47 and the second blower fan 34 in the second operation mode. According to various embodiments, the controller 300 may stop the operation of the first blower fan 47 and operate the second blower fan 34 in the second operation mode. According to various embodiments, the controller 300 may open the first damper 113 and/or the second damper 114 in the second operation mode.

In the second operation mode, the condenser 200 may be cooled by the air in the machine room 32 passing through the condenser 200.

According to various embodiments, in a case where the RPM of the first blower fan 47 and/or the second blower fan 34 may be adjusted, the controller 300 may adjust the RPM of the first blower fan 47 and/or the second blower fan 34 based on the first temperature and/or the second temperature.

For example, the controller 300 may adjust the RPM of the first blower fan 47 to be lower or the RPM of the second blower fan 34 to be higher as the first temperature and/or the second temperature becomes higher.

In an embodiment, the controller 300 may adjust the operating frequency of the compressor 41 to the minimum frequency in the second operation mode, and the operating rate of the compressor 41 may be adjusted to the minimum operating rate. Accordingly, an operating time of the compressor 41 increases to increase the time for removing moisture in the air, thereby increasing the dehumidification effect.

In an embodiment, the controller 300 may turn off the compressor 41 in the second operation mode. Accordingly, efficient heat dissipation of the condenser 200 may be achieved.

According to an embodiment, in a case in which a temperature of the shoe care apparatus continues to rise even though the compressor 41 operates at the preset frequency (e.g., minimum operating frequency) or at the preset operating rate (e.g., minimum operating rate) due to special circumstances, the operation mode of the shoe care apparatus 1 may be switched to the second operation mode to cool the condenser 200.

In addition, according to an embodiment, as the operation mode of the shoe care apparatus 1 is changed from the first operation mode to the second operation mode, the high temperature and humidity air circulating inside the care room 30 may be changed into low temperature and humidity air, and thus the dehumidification performance may be improved.

According to various embodiments, the shoe care apparatus 1 may operate in the second operation mode and switch back to the first operation mode (1400) when heat dissipation of the condenser 200 is completed (YES in 1550).

The controller 300 may switch the operation mode of the shoe care apparatus 1 to the first operation mode (1400) while operating in the second operation mode (1500) based on a temperature (third temperature) for estimating the temperature (third temperature) of the air in the machine room 32, that is, a temperature of the condenser 200 having fallen lower than or equal to the preset temperature (YES in 1550).

In this case, the preset temperature may be set to a temperature at which it may be assumed that the heat dissipation of the condenser 200 is completed.

According to various embodiments, the controller 300 may stop the operation of the second blower fan 34 based on the temperature (third temperature) of the air in the machine room 32 having fallen lower than or equal to the preset temperature while the second blower fan 34 is operating (second operation mode).

According to an embodiment, the controller 300 may close at least one of the first damper 113 and the second damper 114 based on the temperature (third temperature) of the air in the machine room 32 having fallen lower than or equal to the preset temperature when at least one of the first damper 113 and the second damper 114 is opened (second operation mode).

According to an embodiment, when the heat dissipation of the condenser 200 is completed, the operation mode of the shoe care apparatus 1 is switched from the second operation mode back to the first operation mode, so that efficient dehumidification/drying of shoes may be achieved.

The foregoing has illustrated and described various example embodiments. However, it should be understood by those skilled in the art that the present disclosure is not limited to the above-described embodiments, and various changes and modifications may be made without departing from the technical idea of the present disclosure including the following claims.

The disclosed embodiments may be implemented in the form of a recording medium storing instructions executable by a computer. The instructions may be stored in the form of program code, and when executed by a processor, a program module may be created to perform the operations of the disclosed embodiments. The recording medium may be implemented as a computer-readable recording medium.

The computer-readable recording medium includes any type of recording medium in which instructions readable by the computer are stored. For example, the recording medium may include a read only memory (ROM), a random access memory (RAM), a magnetic tape, a magnetic disk, a flash memory, an optical data storage device, and the like.

In addition, the computer-readable recording medium may be provided in the form of a non-transitory storage medium. Herein, the 'non-transitory storage medium' is a tangible device and may not contain signals (e.g. electromagnetic waves), and this term does not distinguish between cases where data is semi-permanently stored in a storage medium and cases where data is stored temporarily. For example, the 'non-transitory storage medium' may include a buffer where data is temporarily stored.

According to an embodiment, methods according to various embodiments disclosed herein may be provided and included in a computer program product. The computer program product is a commodity and may be traded between sellers and buyers. The computer program product may be distributed in the form of a machine-readable recording medium (e.g., compact disc read only memory (CD-ROM), or may be distributed (e.g., downloaded or uploaded) online, through an application store (e.g., Play Store™) or directly between two user devices (e.g., smartphones). In the case of online distribution, at least a portion of the computer program product (e.g., a downloadable app) may be at least temporarily stored or created temporarily in the machine-readable recording medium, such as the memory of a manufacturer server, an application store server, or a relay server.

What is claimed is:

1. A shoe care apparatus comprising:

a main body;

a care room provided in the main body and configured to accommodate shoes;

a machine room provided in the main body and configured to accommodate a heat pump device comprising an evaporator and a condenser;

a circulation flow path communicating with the care room and configured such that air discharged from the care room passes through the evaporator and the condenser and is supplied to the care room;

a first blower fan disposed on the circulation flow path configured to blow air in the circulation flow path in a first direction so that the air in the circulation flow path passes through the machine room from the care room and circulates back to the care room; and a second blower fan disposed in the machine room configured to blow air in the machine room in a second direction so that the air in the machine room passes through the condenser.

2. The shoe care apparatus according to claim 1, further comprising:

a communication hole provided in one wall of the main body configured to communicate the outside of the main body and the machine room;

an inlet configured such that air introduced into the machine room through the communication hole flows into the condenser; and an outlet configured such that air introduced through the inlet passes through the condenser and flows into the machine room, wherein the air flowed out through the outlet flows to the outside of the main body through the communication hole.

3. The shoe care apparatus according to claim 2, further comprising at least one of a first damper configured to open and close the inlet and a second damper configured to open and close the outlet.

4. The shoe care apparatus according to claim 3, wherein the condenser comprises:

a refrigerant pipe configured such that a refrigerant flows therethrough;

a first heat exchange fin configured to exchange heat between the air flowing through the circulation flow path by being blown by the first blower fan and the refrigerant flowing through the refrigerant pipe; and a second heat exchange fin disposed along an up-down direction together with the first heat exchange fin and configured to exchange heat between the air flowing through the condenser by being blown by the second blower fan and the refrigerant flowing through the refrigerant pipe.

5. The shoe care apparatus according to claim 4, wherein the condenser comprises:

a first cover disposed on one side of the second heat exchange fin along the second direction; and a second cover disposed on an other side of the second heat exchange fin along the second direction.

6. The shoe care apparatus according to claim 5, wherein each of the first cover and the second cover comprises:

a cover portion;

an opening formed at the cover portion configured to allow air to flow in the second direction; and a bent portion bent from the cover portion toward the second heat exchange fin to form the opening.

7. The shoe care apparatus according to claim 6, wherein the condenser further comprises a sealing member comprising a seal disposed between the first cover and the second cover along a front-rear direction to seal between the opening and the bent portion on a side of the second heat exchange fin.

8. The shoe care apparatus according to claim 3, wherein:

at least one controller is configured to control an operation of at least one of the first damper and the second damper based on at least one of a temperature of air supplied to the care room, a temperature of the outside air, a temperature of air in the machine room, and operation information of a compressor of the heat pump device.

9. The shoe care apparatus according to claim 8, wherein at least one controller is configured to open at least one of the first damper and the second damper based on the temperature of the air to be supplied to the care room being greater than or equal to a first specified temperature, the outside air temperature being greater than or equal to a second specified temperature, or an operating rate of the compressor being less than or equal to a specified operating rate.

10. The shoe care apparatus according to claim 8, wherein at least one controller is configured to close at least one of the first damper and the second damper based on the temperature of the air in the machine room having fallen lower than or equal to a specified temperature in a state in which the at least one of the first damper and the second damper is opened.

11. The shoe care apparatus according to claim 1, further comprising at least one controller, comprising control circuitry, configured to control the second blower fan based on at least one of a temperature of air to be supplied to the care room, an outside air temperature, a temperature of air in the machine room, and operation information of a compressor of the heat pump device.

12. The shoe care apparatus according to claim 11, wherein at least one controller is configured to operate the second blower fan based on the temperature of the air to be supplied to the care room being greater than or equal to a first specified temperature, the outside air temperature being greater than or equal to a second specified temperature, or an operating rate of the compressor being less than or equal to a specified operating rate.

13. The shoe care apparatus according to claim 11, wherein at least one controller is configured to stop operation of the second blower fan based on the temperature of the air in the machine room having fallen lower than or equal to a specified temperature while the second blower fan operates.

14. A method of controlling a shoe care apparatus, the shoe care apparatus comprising a machine room provided in a main body to accommodate a heat pump device including an evaporator and a condenser, a circulation flow path configured such that air discharged from a care room accommodating shoes passes through the evaporator and the condenser and is supplied to the care room, a first blower fan disposed on the circulation flow path configured to blow air in the circulation flow path in a first direction so that the air in the circulation flow path passes through the machine room from the care room and circulates back to the care room, and a second blower fan disposed in the machine room configured to blow air in the machine room in a second direction so that the air in the machine room passes through the condenser, the control method comprising:

operating the first blower fan based on start of a shoe care course; and operating the second blower fan based on a specified condition being satisfied while the shoe care course is in progress.

15. The method according to claim 14, wherein operating the second blower fan based on the specified condition being satisfied while the shoe care course is in progress comprises:

operating the second blower fan based on at least one of a temperature of air to be supplied to the care room, an outside air temperature, and operation information of a compressor of the heat pump device.

16. The method according to claim 15, wherein operating the second blower fan based on at least one of the temperature of the air to be supplied to the care room, the outside air temperature, and the operation information of the compressor of the heat pump device comprises:

operating the second blower fan based on the temperature of the air to be supplied to the care room being greater than or equal to a first specified temperature, the outside air temperature being greater than or equal to a second specified temperature, or an operating rate of the compressor being less than or equal to a specified operating rate.

17. The method according to claim 14, further comprising:

stopping operation of the second blower fan based on a temperature of the air in the machine room having fallen lower than or equal to a specified temperature while the second blower fan operates.

* * * * *